US009897953B2

(12) United States Patent
Takahashi

(10) Patent No.: US 9,897,953 B2
(45) Date of Patent: Feb. 20, 2018

(54) FIXING DEVICE HAVING HARDNESS ADJUSTING UNIT FOR ADJUSTING A NIP LOAD, AND IMAGE FORMING APPARATUS

(71) Applicant: KONICA MINOLTA, INC., Chiyoda-ku, Tokyo (JP)

(72) Inventor: Koji Takahashi, Toyokawa (JP)

(73) Assignee: KONICA MINOLTA, INC., Chiyoda-ku, Tokyo (JP)

( * ) Notice: Subject to any disclaimer, the term of this patent is extended or adjusted under 35 U.S.C. 154(b) by 0 days.

(21) Appl. No.: 15/178,616

(22) Filed: Jun. 10, 2016

(65) Prior Publication Data

US 2016/0378031 A1 Dec. 29, 2016

(30) Foreign Application Priority Data

Jun. 26, 2015 (JP) ..... 2015-128317

(51) Int. Cl.
*G03G 15/20* (2006.01)
*G03G 15/00* (2006.01)

(52) U.S. Cl.
CPC ..... *G03G 15/2053* (2013.01); *G03G 15/206* (2013.01); *G03G 15/2064* (2013.01); *G03G 15/2067* (2013.01); *G03G 15/5029* (2013.01); *G03G 15/2017* (2013.01); *G03G 2215/00447* (2013.01); *G03G 2215/00514* (2013.01); *G03G 2215/2032* (2013.01)

(58) Field of Classification Search
CPC ..... G03G 15/2053; G03G 15/2017; G03G 15/2067; G03G 2215/00514; G03G 2215/00742; G03G 15/5029; G03G 2215/00447; G03G 2215/00751
See application file for complete search history.

(56) References Cited

U.S. PATENT DOCUMENTS

2008/0152404 A1* 6/2008 Yoshino ..... G03G 15/2053 399/329
2014/0003846 A1* 1/2014 Ohnishi ..... G03G 15/2085 399/322
2016/0154349 A1* 6/2016 Higashiyama ..... G03G 15/2057 399/67

FOREIGN PATENT DOCUMENTS

JP S6122376 A 1/1986
JP 2006349886 A 12/2006
(Continued)

OTHER PUBLICATIONS

The Extended European Search Report dated Nov. 17, 2016, by the European Patent Office in corresponding European Patent Application No. 16173677.2-1568. (8 pages).
(Continued)

*Primary Examiner* — David M Gray
*Assistant Examiner* — Laura Roth
(74) *Attorney, Agent, or Firm* — Buchanan Ingersoll & Rooney PC

(57) ABSTRACT

A fixing device includes a hardness adjusting unit to adjust hardness of an outer circumferential surface of a fixing belt at a nip. When a sheet to be passed through the nip is an envelope, and the envelope is passed through the nip by side-flap sheet passing for feeding the sheet so that a fold line between an envelope body and a flap extends in a sheet passing direction through the nip, the hardness adjusting unit brings the outer circumferential surface of the fixing belt at the nip during passage of the sheet into a softer state than when the sheet is a plain sheet.

18 Claims, 9 Drawing Sheets

(56) References Cited

FOREIGN PATENT DOCUMENTS

| | | | | |
|---|---|---|---|---|
| JP | 2008-003276 | A | | 1/2008 |
| JP | 2008003276 | A | * | 1/2008 |
| JP | 2010-286798 | A | | 12/2010 |
| JP | 2012-13914 | A | | 1/2012 |
| JP | 2012-27174 | A | | 2/2012 |
| JP | 2012027174 | A | * | 2/2012 |
| JP | 2014-202901 | A | | 10/2014 |
| JP | 2014202901 | A | * | 10/2014 |

OTHER PUBLICATIONS

Office Action (Notification of Reasons for Refusal) dated Jun. 20, 2017, by the Japanese Patent Office in corresponding Japanese Patent Application No. 2015-128317, and an English translation of the Office Action. (9 pgs).

* cited by examiner

5: VOLATILE MEMORY ATTACHED TO MAIN UNIT
7: VOLATILE MEMORY ATTACHED TO UNIT

FIG. 7

| PRESSURE ROLLER | TENSION ROLLER | NIP LOAD | WESTERN-STYLE ENV. (HORIZONTAL) | WESTERN-STYLE ENV. (HORIZONTAL) THIN | JAPANESE-STYLE ENV. (LONG, RECT., ETC.) | JAPANESE-STYLE ENV. (LONG, RECT., ETC.), THIN |
|---|---|---|---|---|---|---|
| NORMAL PRESSURE-CONTACT | NORMAL PRESSURE-CONTACT | 450N | × | × | × | × |
| LOW PRESSURE-CONTACT | NORMAL PRESSURE-CONTACT | 60 – 80N | △ | × | ○ | △ |
| LOW PRESSURE-CONTACT | LOW PRESSURE-CONTACT | 40 – 50N | ○ | ○ | ○ | ○ |

×: DEFECTIVE, △: PARTLY DEFECTIVE, ○:GOOD

FIXING DEVICE HAVING HARDNESS ADJUSTING UNIT FOR ADJUSTING A NIP LOAD, AND IMAGE FORMING APPARATUS

CROSS-REFERENCE TO RELATED APPLICATIONS

This application is based upon and claims the benefit of priority from the prior Japanese Patent Application No. 2015-128317 filed on Jun. 26, 2015, the entire contents of which are incorporated herein by reference.

BACKGROUND OF THE INVENTION

1. Field of the Invention

The invention relates to a fixing device and an image forming apparatus and, more particularly, to a fixing device having a fixing belt, and an image forming apparatus including the fixing device.

2. Description of Related Art

Conventionally, an image forming apparatus, such as a copier, a printer, a facsimile machine, and a combined machine including their multiple functions, is configured to form an image on a sheet by fixing a toner image transferred to the sheet by use of a fixing device. The fixing device performs a fixing process to heat the sheet while the sheet is passing through a fixing nip provided between a pair of fixing members placed in pressure contact with each other, thereby fixing the toner image on the sheet.

Some of the above fixing devices of the image forming apparatus are adapted to appropriately form an image even on an envelope which is apt to cause wrinkles or the like during the fixing process. For example, Japanese patent unexamined application publication No. 2008-3276 discloses an image forming apparatus configured, during image formation on an envelope, to adjust pressure contact force at a nip section in a fixing device and a feeding speed of the envelope to be conveyed to the nip section to form an image. Accordingly, the image can be formed even on an envelope with reduced wrinkles or other defects.

However, in the foregoing conventional art, there is a problem with difficulty in forming a good image on an envelope while suppressing wrinkles in the envelope. Specifically, the lower the pressure contact force at the nip section in the fixing device is set, the more the generation of wrinkles in the envelope can be suppressed when the envelope is passing through the nip section. However, the lower pressure contact force at the nip section in the fixing device is more likely to cause a deterioration in fixing property of a toner image to the envelope carrying the image.

The present invention has been made to solve the foregoing problems of the conventional techniques. Specifically, the present invention has objects of providing a fixing device and an image forming apparatus capable of appropriately performing a fixing process of a toner image on an envelope and preventing generation of wrinkles in the envelope carrying the toner image during the fixing process.

SUMMARY OF THE INVENTION

To achieve at least one of the abovementioned objects, a fixing device reflecting one aspect of the present invention is configured to comprise: an endless fixing belt; a heating source to heat the fixing belt; a support member including a support elastic layer formed of elastic material, and a support base having higher rigidity than the support elastic layer, the support member being configured such that the support base supports an inner circumferential surface of the fixing belt through the support elastic layer; and a nip pressing member provided in pressure contact with an outer circumferential surface of the fixing belt in a supported region in which the inner circumferential surface is supported by the support member, the nip pressing member being configured to form a nip at a pressure-contact portion against the outer circumferential surface of the fixing belt, the fixing device being configured to pass a sheet carrying a toner image through the nip to fix the toner image to the sheet, wherein the fixing device further includes a hardness adjusting unit to adjust hardness of the outer circumferential surface of the fixing belt at the nip, and the hardness adjusting unit is configured such that, when the sheet to be passed through the nip is an envelope having a flap, the envelope being conveyed in a sheet passing direction by side-flap sheet passing for feeding the envelope, through the nip, in an orientation that a fold line between an envelope body and a flap extends in the sheet passing direction, the hardness adjusting unit brings the outer circumferential surface of the fixing belt at the nip during passage of the sheet through the nip into a softer state than when the sheet to be passed through the nip is a plain sheet.

In the foregoing fixing device, preferably, the hardness adjusting unit is configured such that when the envelope to be passed through the nip by the side-flap sheet passing has a grammage less than a predetermined first grammage threshold, the hardness adjusting unit brings the outer circumferential surface of the fixing belt at the nip during passage of the sheet through the nip into a softer state than when an envelope has a grammage equal to or higher than the first grammage threshold.

In the foregoing fixing device, preferably, the hardness adjusting unit is configured such that, when the sheet to be passed through the nip is an envelope having a flap, the envelope being conveyed in a sheet passing direction by end-flap sheet passing for feeding the envelope, through the nip, in an orientation that a fold line between an envelope body and a flap extends in a width direction of the fixing belt, and the envelope to be passed through the nip by the end-flap sheet passing having a grammage less than a predetermined second grammage threshold, the hardness adjusting unit brings the outer circumferential surface of the fixing belt at the nip during passage of the sheet through the nip into a softer state than when the sheet to be passed through the nip is a plain sheet.

In the foregoing fixing device, preferably, the hardness adjusting unit is configured such that, when the sheet to be passed through the nip is an adhesive envelope having adhesive with which a flap is bonded to an envelope body, the hardness adjusting unit brings the outer circumferential surface of the fixing belt at the nip during passage of the sheet through the nip into a softer state than when the sheet is a non-adhesive envelope having no adhesive.

In the foregoing fixing device, preferably, the hardness adjusting unit includes: a first tension roller oriented with its axis extending in a width direction of the fixing belt, the first tension roller being placed in pressure contact with a first pressure-contact region of the fixing belt in which the inner circumferential surface is not supported; and a first urging adjusting unit configured to urge the first tension roller against the first pressure-contact region of the fixing belt and to adjust an urging force of the first tension roller, and the first urging adjusting unit is configured to set the urging force of the first tension roller to be lower to adjust the outer circumferential surface of the fixing belt at the nip to a softer state.

In the foregoing fixing device, preferably, the first tension roller has a crown shape radially expanding in a central portion more than in both end portions in an axial direction, and the first tension roller has a most radially expanded portion located in a position corresponding to a center position of the envelope, in the width direction of the fixing belt, to be passed through the nip by the side-flap sheet passing.

In the foregoing fixing device, preferably, the hardness adjusting unit includes: a second tension roller oriented with its axis extending in the width direction of the fixing belt, the second tension roller being placed in pressure contact with a second pressure-contact region of the fixing belt in which the inner circumferential surface is not supported; and a second urging adjusting unit configured to urge the second tension roller against the second pressure-contact region of the fixing belt and to adjust an urging force of the second tension roller, and the second tension roller has an inverted crown shape radially recessed in both ends more than in a central portion in an axial direction, the second tension roller has a most radially recessed portion located in a position corresponding to the most radially expanding portion of the first tension roller, in the width direction of the fixing belt, and the second urging adjusting unit is configured to set an urging force of the second tension roller to be smaller to adjust the outer circumferential surface of the fixing belt at the nip to a softer state.

In the foregoing fixing device, preferably, when the sheet to be passed through the nip has a length in the width direction of the fixing belt is longer than a predetermined threshold length, the first urging adjusting unit and the second urging adjusting unit respectively adjust the urging force of the first tension roller and the urging force of the second tension roller so that a tensile force applied to the fixing belt is uniform in the width direction.

Preferably, the foregoing fixing device further includes a nip pressure adjusting unit to adjust pressure contact force of the nip pressing member to an outer circumferential surface of the fixing belt, wherein when the sheet to be passed through the nip is an envelope, the nip pressure adjusting unit sets the urging force of the nip pressing member during passage of the sheet through the nip to be lower than when the sheet is a plain sheet.

In the foregoing fixing device, preferably, the support member is a roller member provided with the support elastic layer on a surface of the support base, the nip pressing member is a roller member provided with a pressing elastic layer having elasticity and a pressing base having higher rigidity than the pressing elastic layer, the pressing elastic layer being provided on a surface of the pressing base material, and the support elastic layer has a thickness larger than the pressing elastic layer.

The foregoing fixing device preferably further includes a heating roller formed of a roller member to be heated by the heating source and configured to support the inner circumferential surface of the fixing belt other than the supported region, and wherein the heating source is configured to heat the fixing belt through the heating roller.

Further, an image forming apparatus reflecting another aspect of the invention is configured to comprise: a conveying unit for conveying a sheet; an image forming unit configured to transfer a toner image to the sheet; and the fixing device according to claim 1, provided more downstream than the image forming unit in a sheet conveying direction.

BRIEF DESCRIPTION OF THE DRAWINGS

FIG. 7 is a table showing experimental results in the second embodiment;

DESCRIPTION OF EMBODIMENTS

A detailed description of preferred embodiments of the present invention will now be given referring to the accompanying drawings. In the present embodiment, the invention is applied to an electrophotographic printer.

First Embodiment

Figure 1:
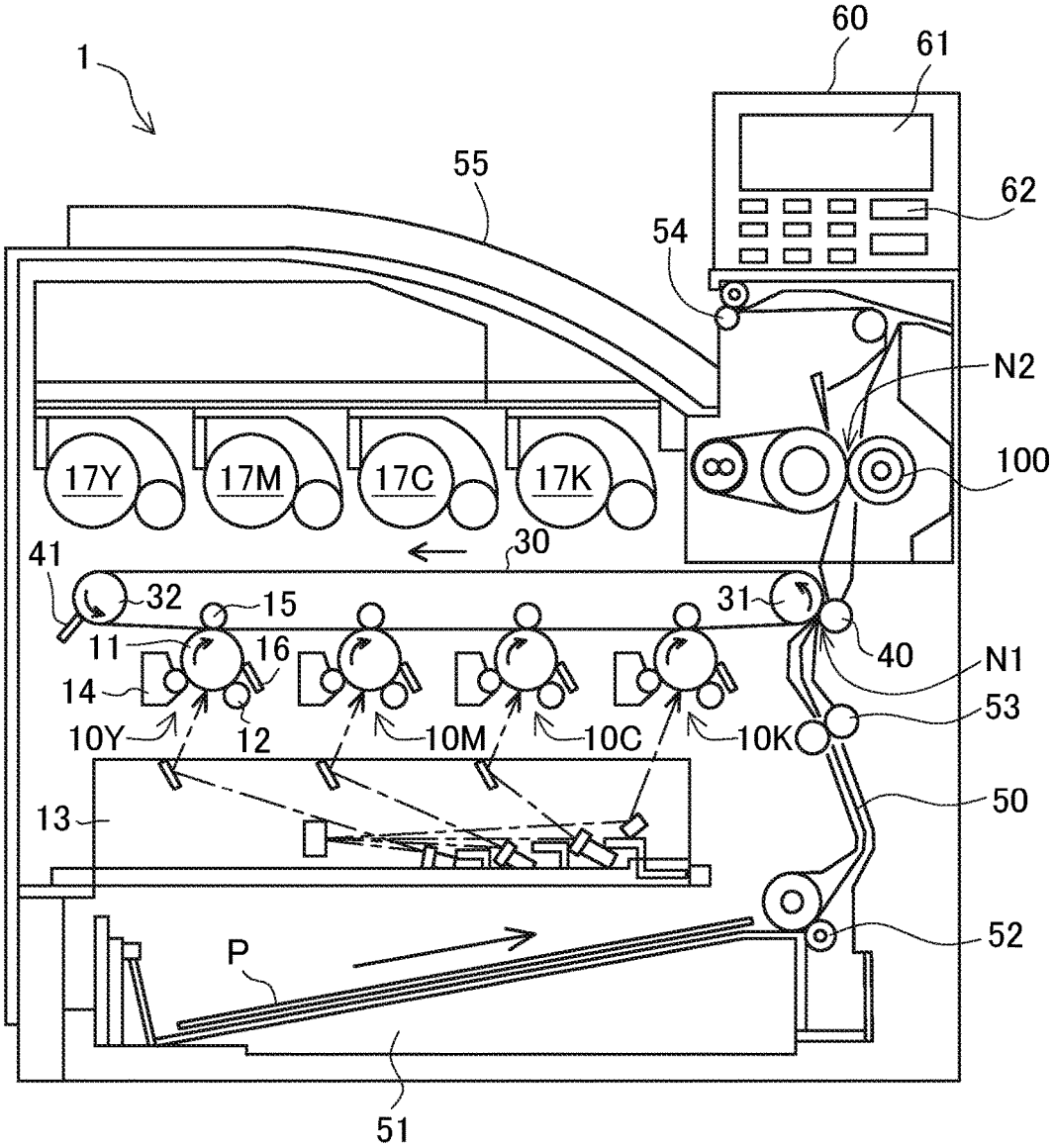
FIG. 1 is a schematic configuration view of an image forming apparatus in a first embodiment.

FIG. 1 shows a schematic structure of an image forming apparatus 1 in the present embodiment. This image forming apparatus 1 is a so-called tandem color printer including an intermediate transfer belt 30. This intermediate transfer belt 30 is an endless belt member having electric conductivity. Both ends of the belt 30 in FIG. 1 are supported by rollers 31 and 32. During image formation, the roller 31 on a right side in FIG. 1 is driven to rotate counterclockwise. This causes the intermediate transfer belt 30 and the roller 32 on a left side in FIG. 1 to be rotated in each direction indicated by arrows in FIG. 1.

A secondary transfer roller 40 is provided in contact with an outer circumferential surface of a part of the intermediate transfer belt 30 supported by the roller 31 on the right side in FIG. 1. Specifically, the secondary transfer roller 40 is pressed against the intermediate transfer belt 30 in a direction (leftward in FIG. 1) perpendicular to an axis of the roller 40. Contact portions of the intermediate transfer belt 30 and the secondary transfer roller 40 form therebetween a transfer nip N1 at which a toner image is transferred from the intermediate transfer belt 30 onto a sheet P. During image forming, the secondary transfer roller 40 is driven to rotate by a frictional force caused by pressure contact with the intermediate transfer belt 30 under rotation.

Further, a belt cleaner 41 is placed in contact with an outer circumferential surface of a part of the intermediate transfer belt 30 supported by the roller 32 on the left side in FIG. 1. In particular, the belt cleaner 41 is placed in pressure contact with the outer circumferential surface of the intermediate transfer belt 30. The belt cleaner 41 serves to collect residual toner having been not transferred onto the sheet P at the transfer nip N1.

Image forming units 10Y, 10M, 10C, and 10K for respective colors; yellow (Y), magenta (M), cyan (C), and black (K), are arranged in order from left to right under the intermediate transfer belt 30 in FIG. 1. Each of the image forming units 10Y, 10M, 10C, and 10K is used to form a toner image of a relevant color and transfer it onto the intermediate transfer belt 30. The image forming units 10Y, 10M, 10C, and 10K are identical in structure and thus only the image forming unit boy is assigned reference signs in FIG. 1.

Each of the image forming units 10Y, 10M, 10C, and 10K includes a photoconductor 11 which is a cylindrical electrostatic latent image carrier, and a charger 12, a developing device 14, and a photoconductor cleaner 16, which are arranged circumferentially around the photoconductor 11. A primary transfer roller 15 is placed in a position opposed to the photoconductor 11 by interposing the intermediate transfer belt 30 therebetween. Further, an exposing device 13 is placed below the image forming units 10Y, 10M, 10C, and 10K for each color in FIG. 1.

The charger 12 is arranged to uniformly charge a surface of the photoconductor 11. The exposing device 13 is arranged to irradiate a laser beam based on image data to the surface of the corresponding photoconductor 11 to form an electrostatic latent image thereon. The developing device 14 is arranged to apply toner stored therein to the surface of the photoconductor 11.

Each primary transfer roller 15 is pressed against the intermediate transfer belt 30 from a direction perpendicular to the axis of each roller 15 (a downward direction in FIG. 1). By this pressure contact, contact portions of the intermediate transfer belt 30 and each photoconductor 11 form a primary transfer nip for transferring a toner image from the photoconductors 11 for each color onto the intermediate transfer belt 30. The photoconductor cleaner 16 is arranged to collect the toner having been not transferred to the intermediate transfer belt 30 and remaining on the corresponding photoconductor 11.

In FIG. 1, the charger 12 is illustrated as a roller-shaped charging type, but the present invention is not limited to this. As another example, a corona charging charger, a blade-shaped charging element, or a brush-shaped charging element or the like may be used. Further, the photoconductor cleaner 16 is illustrated as a plate-shaped cleaner, which is placed with its one end portion resting on the outer circumferential surface of the photoconductor 11, but the present invention is not limited to this. As still another example, cleaning members such as a fixed brush, a rotating brush, a roller, may be used alone or in combination. In another example of using a cleaner-less type in which the residual toner on the photoconductor 11 is collected by the developing device 14, the photoconductor cleaner 16 may be omitted.

Further, above the intermediate transfer belt 30 in FIG. 1, hoppers 17Y, 17M, 17C, and 17K respectively storing toners of yellow, magenta, cyan, and black are provided. The toners stored in these hoppers are appropriately supplied to the corresponding-color developers 14.

In a lower part of the image forming apparatus 1, a sheet feeding cassette ("sheet cassette") 51 is detachably mounted. From a right side of the sheet cassette 51, a sheet feed passage 50 is provided to extend upward in FIG. 1. Sheets P stacked in the sheet cassette 51 are to be fed one by one from a topmost one to the sheet feed passage 50 by sheet feed rollers 52.

On the sheet feed passage 50 into which a sheet P is fed by the sheet feed rollers 52, a pair of paper stop rollers (resist rollers) 53, the transfer nip N1, a fixing device 100, and ejecting rollers 54 are arranged in this order from an upstream side. On a further downstream side of the sheet feed passage 50, the image forming apparatus 1 is further provided on its top surface with a sheet output part 55. The resist rollers 53 are configured to adjust the timing of delivering the sheet P to the transfer nip N1. The fixing device 100 is configured to perform a fixing process to heat and press the sheet P at the fixing nip N2 to fix a toner image transferred onto the sheet P.

The image forming apparatus 1 in the present embodiment includes an operation unit 60 to enable a user to operate the image forming apparatus 1. The operation unit 60 includes a display panel 61 and an input part 62. The operation unit 60 in the present embodiment is used to input the type of a sheet(s) P stacked in the sheet cassette 51.

Specifically, when the sheet P stacked in the sheet cassette 51 is a plain sheet, or regular paper, for example, a user can enter the size of the plain sheet on the operation unit 60. In another case where the sheet(s) P stacked in the sheet cassette 51 is a special sheet(s) different from the plain sheet, a user can enter the type, grammage (basis weight), and others of the special sheet on the operation unit 60.

Figure 2:
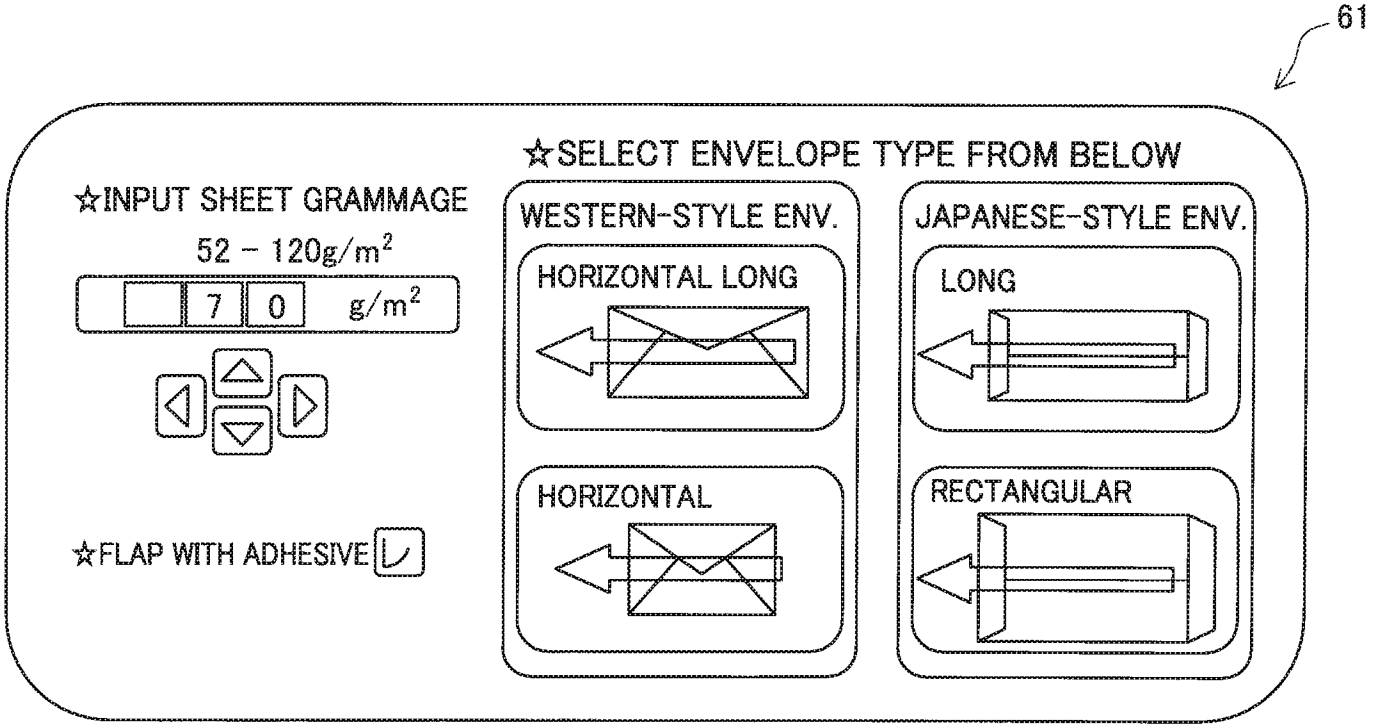
FIG. 2 is a diagram of an envelope setting screen on a display panel of the image forming apparatus.

When the sheet(s) P stacked in the sheet cassette 51 is an envelope which is one of special sheets, a user can set the details of the envelope. Concretely, when the sheet P is an envelope, a screen shown in FIG. 2 can be displayed on the display panel 61. In other words, the user can input the type of the sheet P; a Western-style envelope (a horizontal envelope with an opening/flap on a long edge) or a Japanese-style envelope (a vertical (long/rectangular) envelope with an opening/flap on a short edge), as shown in FIG. 2. Further, the user also can input the grammage of the envelope and whether or not the envelope is an adhesive envelope applied with adhesive in advance to allow a flap to be bonded to an envelope body.

In the image forming apparatus 1 in the present embodiment, the Western-style envelope is conveyed in such an orientation that a fold line between an envelope body and a flap of the Western-style envelope extends in the conveying direction as indicated by outline arrows in FIG. 2. In contrast, the Japanese-style envelope is conveyed in such an orientation that a flap protrudes from an envelope body of the Japanese-style envelope in the conveying direction, that is, a fold line between the envelope body and the flap extends perpendicular to the conveying direction, as indicated by outline arrows in FIG. 2.

One example of normal image forming operations in the image forming apparatus 1 in the present embodiment will be briefly described below. The following example shows an image forming operation to be performed when a color image to be formed by use of four-color toners on a sheet P stacked in the sheet cassette 51.

During formation of a color image, the intermediate transfer belt 30 and the photoconductors 11 for each color are rotated at predetermined circumferential speeds in the corresponding directions indicated by the arrows in FIG. 1. The outer peripheral surface of each photoconductor 11 is uniformly charged by the corresponding charger 12. The charged outer peripheral surface of each photoconductor 11 is irradiated with the light according to image data by the exposing device 13 to form an electrostatic latent image. Subsequently, each electrostatic latent image is developed by the corresponding developing device 14, and thus a toner image is formed on each photoconductor 11.

The toner images formed on the photoconductors 11 are transferred onto the intermediate transfer belt 30 by the primary transfer rollers 15 (Primary transfer). Thus, yellow, magenta, cyan, and black toner images are superimposed in this order on the intermediate transfer belt 30. The thus superimposed four-color toner image is conveyed to the transfer nip N1 by rotation of the intermediate transfer belt 30. In contrast, residual toner that has not been transferred to the intermediate transfer belt 30 and remains on the photoconductor 11 even after the image passes through the primary transfer roller 15 is scraped by the photoconductor cleaner 16 and removed from the photoconductor 11.

Meanwhile, the sheets P stacked in the sheet feeding cassette 51 are individually picked up from a topmost one and conveyed to the transfer nip N1 along the conveying path 50. The timing at which each sheet P enters the transfer nip N1 is finely adjusted by the resist rollers 53 so as to coincide with the timing at which the toner image on the intermediate transfer belt 30 enters the transfer nip N1. At the transfer nip N1, accordingly, the superimposed four-color toner image is transferred to the sheet P (Secondary transfer).

The sheet P with the toner image transferred thereon is further conveyed to a downstream side of the conveying path 50. Specifically, the sheet P is fixed with the toner image by the fixing device 100 and then is ejected to the sheet output part 55 by the ejecting rollers 54. It is to be noted that untransferred residual toner remaining on the intermediate transfer belt 30 even after passing through the transfer nip N1 is collected by the belt cleaner 41, and finally removed from the intermediate transfer belt 30.

Figure 3:
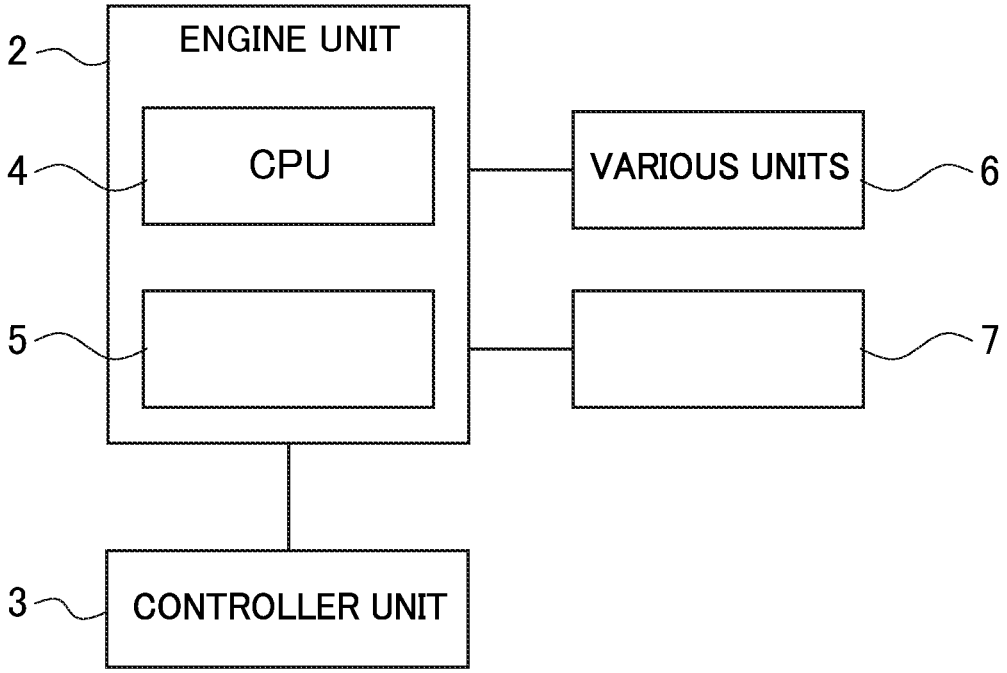
FIG. 3 is a schematic diagram of a control configuration of the image forming apparatus.

FIG. 3 schematically shows a control structure of the image forming apparatus 1. The image forming apparatus 1 includes an engine unit 2 and a controller unit 3 to control each part. The engine unit 2 has a CPU 4 for performing the overall control process and a nonvolatile memory 5 attached to a main unit of the apparatus.

The nonvolatile memory 5 stores in advance various values to be used for image forming or others in the image forming apparatus 1. For example, the stored values include a system speed corresponding to the speed for conveying a sheet P and a formed toner image.

The CPU 4 controls each part in the image forming apparatus 1 based on the values stored in the nonvolatile memory 5. For instance, the timing of starting to form each electrostatic latent image by use of the exposing device 13 is adjusted to form a color toner image with no displacement on the intermediate transfer belt 30. The CPU 4 controls the image forming apparatus 1 to adjust the timing of forming an image by use of the image forming units 10Y, 10M, 10C, and 10K and the timing of feeding a sheet P from the sheet cassette 51, thereby making their timings of entering the transfer nip N1.

The engine unit 2 controls various units 6 included in the image forming apparatus 1 and also performs writing and reading operations with respect to a nonvolatile memory or memories 7 attached to various units. The various units 6 include an imaging unit, for example. Of the nonvolatile memories 7 attached to the various units, for example, a memory attached to the imaging unit stores the number of sheets formed with images by the imaging unit.

The controller unit 3 is connected to an external personal computer or the like and configured to receive a command input therefrom. For instance, when the controller unit 3 receives a command signal for image formation from a personal computer, an image forming job is generated in the image forming apparatus 1. Furthermore, the engine unit 2 and the controller unit 3 perform communications on various information such as a dot counter value.

Figure 4:
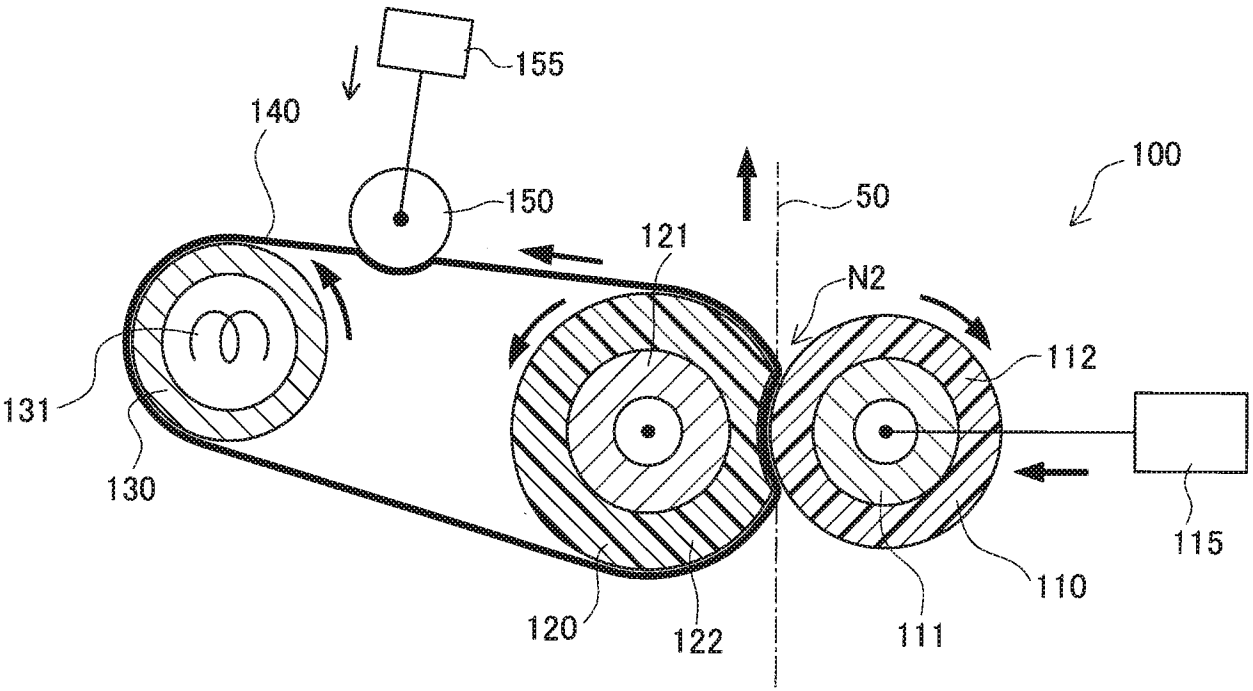
FIG. 4 is a schematic configuration view of a fixing device in a first embodiment.

Next, the fixing device 100 in the present embodiment will be described. FIG. 4 is a schematic configuration view of this fixing device 100. The fixing device 100 includes, as shown in FIG. 4, a pressure roller 110, a fixing roller 120, a heating roller 130, and a fixing belt 140. These fixing roller 120, heating roller 130, and fixing belt 140 are arranged on a side facing the surface of a sheet P bearing a toner image. Further, as shown in FIG. 4, the fixing belt 140 is an endless belt member and is wound around the fixing roller 120 and the heating roller 130.

The fixing roller 120 includes a metal core 121 and an elastic layer 122 covering the outer periphery of the metal core 121. To be concrete, the metal core 121 of the fixing roller 120 in the present embodiment is a hollow cylindrical member having a thickness of 2 mm. In the present embodiment, the metal core 121 is made of iron. The elastic layer 122 is formed of elastic material with a thickness of 6 mm. In the present embodiment, the elastic layer 122 is made of silicone rubber. The fixing roller 120 may further include a reinforcement layer or the like as an outermost layer on the outer periphery of the elastic layer 122 to reinforce the elastic layer 122.

The heating roller 130 includes a metal core and a fluorine contained resin with a 10 mm thickness on the metal core. The metal core of the heating roller 130 is a hollow cylindrical member having a thickness of 0.6 mm and contains a heater 131 therein. As the heater 131, a halogen heater or the like can be used.

The fixing belt 140 includes a base layer located on an innermost circumference, an outer layer located on an outermost circumference, and an elastic layer located between the base layer and the outer layer. In the present embodiment, the base layer of the fixing belt 140 is made of polyimide with a 70 μm thickness, the outer layer of the fixing belt 140 is made of fluorine contained resin with a 30 μm thickness, and the elastic layer of the fixing belt 140 is made of silicone rubber with a 150 μm thickness.

The pressure roller 110 and the fixing roller 120 are arranged on opposite sides of the fixing belt 140 interposed therebetween. The pressure roller 110 is urged toward the fixing roller 120 by a pressure adjusting unit 115. Accordingly, the pressure roller 110 is pressed against the outer circumferential surface of the fixing belt 140. In this state, the fixing nip N2 is formed at a pressure-contact portion of the pressure roller 110 against the fixing belt 140. The pressure adjusting unit 115 is configured to adjust the pressure contact force of the pressure roller 110. A concrete structure of the pressure adjusting unit 115 may be selected from a cam mechanism, a link mechanism, and others.

The pressure roller 110 includes, as shown in FIG. 4, a metal core 111 and an elastic layer 112 covering the outer periphery of the metal core 111. To be concrete, the metal core 111 of the pressure roller 110 is a hollow cylindrical member having a thickness of 2 mm. In the present embodiment, the metal core 111 is made of aluminum. The elastic layer 112 is formed of elastic material with a thickness of 1 mm. In the present embodiment, the elastic layer 112 is made of silicone rubber. The pressure roller 110 in the present embodiment includes a release layer having a thickness 30 μm as an outermost layer.

During execution of the fixing process, the fixing roller 120 is driven to rotate counterclockwise as indicated by an arrow in FIG. 4. This rotation of the fixing roller 120 causes the pressure roller 110, the heating roller 130, and the fixing belt 140 to be rotated in respective directions indicated by corresponding arrows in FIG. 4.

During execution of the fixing process, the heater 131 heats the heating roller 130 to raise the temperature of the fixing belt 140 through the heating roller 130. In other words, during the fixing process, the fixing nip N2 is heated to a predetermined temperature. Thus, the sheet P is heated and pressed while passing through the fixing nip N2. By this fixing process at the fixing nip N2, a toner image transferred to the sheet P at the transfer nip N1 is fixed on the sheet P.

The fixing device 100 in the present embodiment includes a tension roller 150 placed in pressure contact with the outer peripheral surface of an upper part of the fixing belt 140 as shown in FIG. 4. The tension roller 150 consists of a columnar iron core coated with a fluorine contained layer with a 30 μm thickness. That is, the tension roller 150 in the present embodiment has a uniform diameter in an axial direction. Further, the tension roller 150 is oriented with its axis extending in the width direction of the fixing belt 140 and is urged by a tension adjusting unit 155.

A region of the fixing belt 140 pressed by the tension roller 150 is a part whose inner circumferential surface is not supported by, that is, not in direct contact with, both the fixing roller 120 and the heating roller 130. Accordingly, while the tension roller 150 is pressed against the fixing belt 140, a tensile force is applied to the fixing belt 140. The tension adjusting unit 155 can adjust the pressure contact force of the tension roller 150. A concrete structure of the tension adjusting unit 155 may be selected from a cam mechanism, a link mechanism, and others.

Herein, the fixing device 100 in the present embodiment can adjust the pressure contact force of the pressure roller 110 by the pressure adjusting unit 115 as described above. Adjusting the pressure contact force of the pressure roller 110 can be performed by adjusting the urging force of the pressure adjusting unit 115 to the pressure roller 110. This adjusting of the pressure contact force of the pressure roller 110 by the pressure adjusting unit 115 is performed when the sheet P is an envelope.

Specifically, when the sheet P is a plain sheet, the pressure adjusting unit 115 is operated to bring the pressure roller 110 into a normal pressure-contact state in which the pressure contact force of the pressure roller 110 is set to a normal pressure contact force allowing a toner image to be appropriately fixed on a plain sheet at the fixing nip N2. In contrast, when the sheet P is an envelope, the pressure adjusting unit 115 is operated to bring the pressure roller 110 into a low-pressure contact state in which the pressure contact force of the pressure roller 110 is set to a lower pressure contact force than the normal pressure contact force set for the plain sheet.

In general, envelops each include a front face and a back face overlapping each other, constituting an envelope body, to enclose paper and others. Each envelope also includes an opening for insertion of paper and others and a flap for closing the opening. If an envelope is passed through the fixing nip N2 provided by the pressure roller 110 in the normal pressure-contact state which is the same state for the plain sheet, wrinkles and others are apt to be generated in the envelope.

Specifically, when an envelope is passed through the fixing nip N2 under the same pressure contact force of the pressure roller 110 as the pressure contact force for the plain sheet, for example, wrinkles may occur in a fold line between the flap and the envelope body. Further, flap displacement may occur in which the flap is displaced at a slant with respect to the envelope body. As the pressure contact force of the pressure roller 110 at the fixing nip N2 is set lower, a nip load to be applied to the sheet P during passage through the fixing nip N2 can be decreased. Decreasing the nip load also makes it less likely to generate wrinkles or the like in an envelope at the time of passing through the fixing nip N2.

Herein, the image forming apparatus 1 in the present embodiment is configured to convey a Western-style envelope in an orientation that the extending direction of a fold line between an envelope body and a flap aligns with the conveying direction as described in FIG. 2. In contrast, a Japanese-style envelope is conveyed in an orientation that the protruding direction of a flap from an envelope body aligns with the conveying direction.

In the image forming apparatus in the present embodiment, specifically, a Western-style envelope(s) is subjected to the fixing process by a side-flap sheet passing operation for feeding the envelope, through the fixing nip N2, in an orientation that the fold line between the envelope body and the flap extends in a sheet passing direction so that the flap is positioned on a long edge (a right or left side in the sheet passing direction) of the envelop body. This operation is also simply referred to as "side-flap sheet passing". In contrast, a Japanese-style envelope(s) is subjected to the fixing process by an end-flap sheet passing operation for feeding the envelope, through the fixing nip N2, in an orientation that the fold line between the envelope body and the flap extends in the width direction of the fixing belt 140 so that the flap is positioned on a short edge (a front or rear end in the sheet passing direction) of the envelop body. This operation is also simply referred to as "end-flap sheet passing".

In the image forming apparatus 1 configured as above, the Western-style envelope to be passed through the fixing nip N2 by the side-flap sheet passing is more likely to cause wrinkles and others at the time of passing through the fixing nip N2 than the Japanese-style envelope to be passed through the fixing nip N2 by the end-flap sheet passing. In the low-pressure contact state of the pressure roller 110 for the sheet P being an envelope, the pressure adjusting unit 115 in the present embodiment adjusts the pressure contact force of the pressure roller 110 to a degree that generates no wrinkles in a Japanese-style envelope.

However, even in the low-pressure contact state where the pressure contact force of the pressure roller 110 at the fixing nip N2 is decreased to such a. degree as not to cause wrinkles and others in a Japanese-style envelope, it may be impossible to suppress the generation of wrinkles and others in a Western-style envelope more likely to cause wrinkles and others than the Japanese-style envelope. Moreover, it is not preferable to set the pressure contact force of the pressure roller 110 at the fixing nip N2 to a too low value. That is, it is not preferable to decrease the pressure contact force of the pressure roller 110 at the fixing nip N2 to a degree that causes no wrinkles and others in a Western-style envelope.

This is because the too low pressure contact force of the pressure roller 110 results in an excessively low fixing property or strength of the toner image. This may cause a fixing failure of the toner image. When the pressure contact force of the pressure roller 110 is too low, furthermore, the drive force of the fixing roller 120 could not be appropriately transmitted to the pressure roller 110 and the fixing belt 140. This may cause a feeding failure of a sheet P.

In the fixing device 100 in the present embodiment, therefore, for the sheet P being a Western-style envelope, the nip load at the fixing nip N2 is set low, thereby adjusting the hardness of the outer circumferential surface of the fixing belt 140 at the fixing nip N2. This adjusting of the hardness of the outer circumferential surface of the fixing belt 140 at the fixing nip N2 can be concretely performed by the tension adjusting unit 155.

In the present embodiment, the hardness of the outer circumferential surface of the fixing belt 140 at the fixing nip N2 is a hardness measured by a C-type Asker rubber hardness meter. A point to be measured by the Asker rubber hardness meter is on the outer circumferential surface of the fixing belt 14 near the fixing nip N2. To be concrete, the measurement point by the Asker rubber hardness meter is in a region on the outer circumferential surface of the fixing belt 140 supported by the fixing roller 120 while the fixing belt 140 is wound around the fixing roller 120 and the heating roller 130.

As described above, the tension adjusting unit 155 can adjust the pressure contact force of the tension roller 150. The tension adjusting unit 155 can make this adjustment of the pressure contact force of the tension roller 150 by controlling the urging force of the tension roller 150. By adjusting the pressure contact force of the tension roller 150, the tension adjusting unit 155 can adjust the tensile force to be applied to the fixing belt 140. Through this adjustment of the tensile force on the fixing belt 140, the tension adjusting unit 155 can control the hardness of the outer circumferential surface of the fixing belt 140 at the fixing nip N2. In the present embodiment, specifically, the tension roller 150 and the tension adjusting unit 155 constitute a hardness adjusting unit.

The inner circumferential surface of the fixing belt 140 at the fixing nip N2 is supported by the fixing roller 120 having the elastic layer 122 as shown in FIG. 4. The elastic layer 122 of the fixing roller 120 under compression load in its thickness direction tends to more harden than in a state free from the compression load. The elastic layer 122 of the fixing roller 120 tends to more harden under higher compression load.

As a larger tensile force is applied to the fixing belt 140, the elastic layer 122 at the fixing nip N2 receives higher compression load in its thickness direction. The tension adjusting unit 155 in the present embodiment, accordingly, adjusts the pressure contact force of the tension roller 150 to control the hardness of the outer circumferential surface of the fixing belt 140 at the fixing nip N2.

Specifically, the tension adjusting unit 155 adjusts the pressure contact force of the tension roller 150 to be lower in order to more decrease the tensile force to be applied to the fixing belt 140. The lower the tensile force applied to the fixing belt 140, the outer circumferential surface of the fixing belt 140 at the fixing nip N2 can be brought into a softer state, namely, a lower tension state. As described above, the tension adjusting unit 155 in the present embodiment makes adjustment of the pressure contact force of the tension roller 150 in a case where the sheet P is a Western-style envelope.

To be concrete, when the sheet P is a plain sheet, the tension adjusting unit 155 in the present embodiment establishes the normal pressure-contact state in which the pressure contact force of the tension roller 150 is set to the normal pressure contact force. When the sheet P is a Japanese-style envelope, similarly, the tension adjusting unit 155 in the present embodiment establishes the same normal pressure-contact state as in the case where the sheet P is a plain sheet.

In contrast, when the sheet P is a Western-style envelope, the tension adjusting unit 155 establishes the low-pressure contact state in which the pressure contact force of the tension roller 150 is set lower than the normal pressure contact force set for the plain sheet or Japanese-style envelope as the sheet P. Since the outer circumferential surface of the fixing belt 140 at the fixing nip N2 is brought into the softer state, even the Western-style envelope more likely to cause wrinkles and other defects than the plain sheet and the Japanese-style envelope can be prevented from getting wrinkled. This is because the nip load at the fixing nip N2 can be further reduced.

Figure 5:
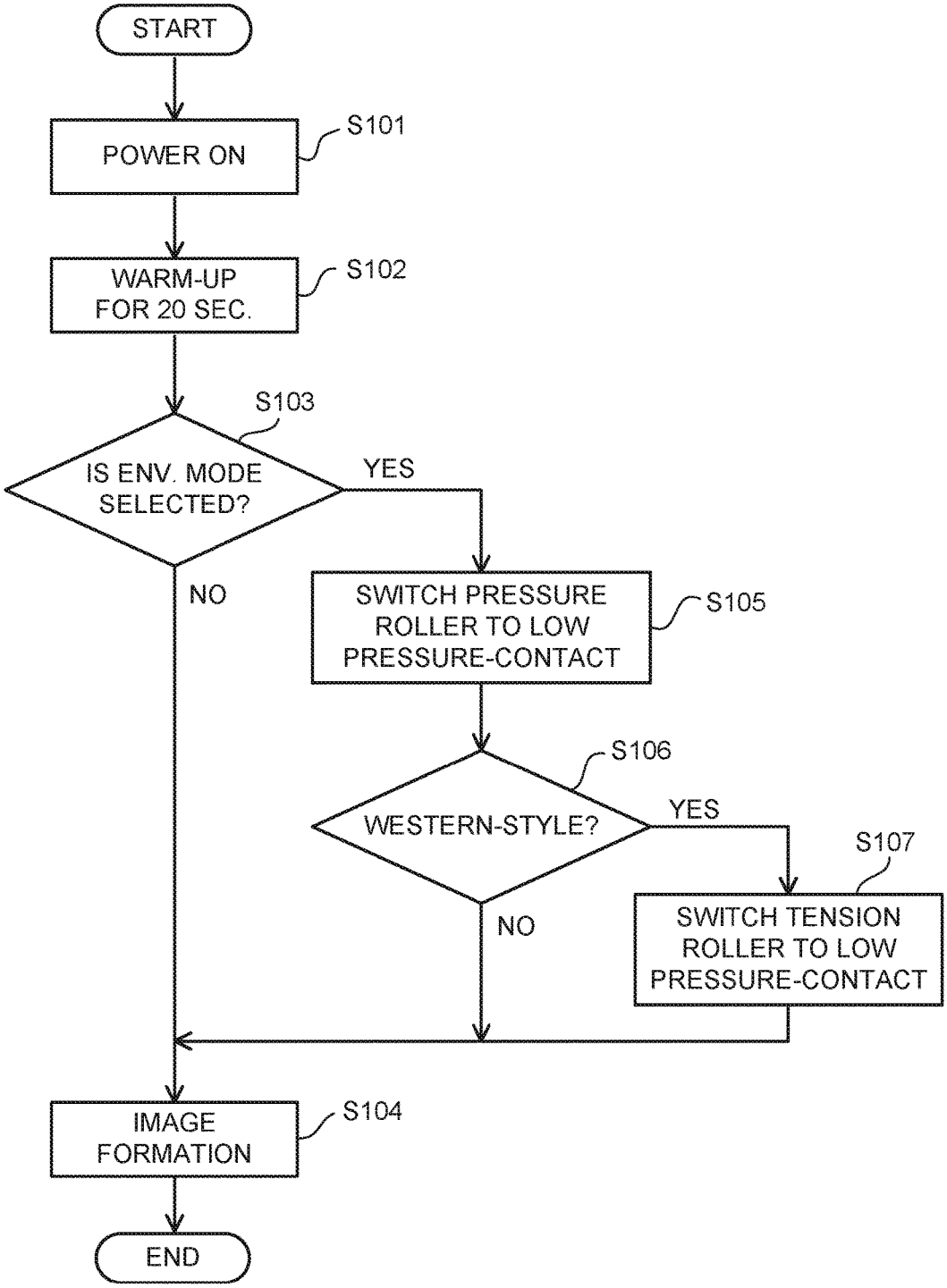
FIG. 5 is a flowchart showing a process of explaining adjustment of pressure contact force of a tension roller in the first embodiment.

FIG. 5 is a flowchart to explain adjustment of the pressure contact force of the tension roller 150 in the present embodiment. As shown in FIG. 5, when the image forming apparatus 1 is powered on (S101), the CPU 4 warms up the fixing device 100 for 20 seconds (S102). This warm-up operation is executed to enable the fixing device 100 to perform the fixing process.

In the default setting at the time of power-on of the image forming apparatus 1, the pressure roller 110 is set in the normal pressure-contact state of applying the normal pressure contact force to a plain sheet when passing through the fixing nip N2. In the default setting of the image forming apparatus 1, the tension roller 150 is set in the normal pressure-contact state of applying the normal pressure contact force to a plain sheet when passing through the fixing nip N2.

The CPU 4 determines whether or not an envelope mode is selected (S103). This determination about whether or not the envelope mode is set is performed based on whether or not a user sets the sheet P stacked in the sheet cassette 51 is an envelope by operation of the operation unit 60.

When the envelope mode is not selected, the sheet P stacked in the sheet cassette 51 is determined to be a plain sheet (S103: NO). The image forming apparatus 1 thus executes image formation on the sheet P which is the plain sheet (S104).

Specifically, for the sheet P which is the plain sheet, the image formation is performed with the pressure roller 110 and the tension roller 150 controlled in the normal pressure-contact state corresponding to the default setting. Accordingly, the fixing device 100 can appropriately perform the fixing process on the plain sheet as the sheet P.

When the envelope mode is selected (S103: YES), the CPU 4 switches the pressure roller 110 from the default setting, i.e., the normal pressure-contact state, to the low-pressure contact state with a low pressure contact force (S105). Accordingly, the nip load at the fixing nip N2 is adjusted to be lower than when the pressure roller 110 is in the normal pressure-contact state.

Successively, the CPU 4 determines whether or not the setting in the envelope mode is a Western-style envelope (S106). This determination about whether or not the setting in the envelope mode is a Western-style envelope is made on whether or not the user sets a Western-style envelope as the sheet P stacked in the sheet cassette 51 by means of the operation unit 60.

When the setting in the envelope mode is not a Western-style envelope, the sheet P stacked in the sheet cassette 51 is determined to be a Japanese-style envelope (S106: NO). The image forming apparatus 1 thus executes the image formation on the sheet P, i.e., the Japanese-style envelope (S104).

Specifically, the sheet P which is the Japanese-style envelope is subjected to the image formation with the pressure roller 110 placed in the low-pressure contact state with a low pressure contact force. At this time, the sheet P, or the Japanese-style envelope, is subjected to the image formation with the tension roller 150 placed in the normal pressure-contact state set as the default setting. Accordingly, the fixing device 100 appropriately performs the fixing process even when the sheet P is a Japanese-style envelope more likely to get wrinkled than the plain sheet.

When the setting in the envelope mode is the Western-style envelope, in contrast, the sheet P stacked in the sheet cassette 51 is determined to be a Western-style envelope (S106: YES). In this case, the CPU 4 switches the tension roller 150 from the default setting, i.e., the normal pressure-contact state to the low-pressure contact state with a low pressure contact force (S107). Accordingly, the nip load at the fixing nip N2 is made lower than the nip load applied by the tension roller 150 in the normal pressure-contact state. Thus, the image forming apparatus 1 performs the image formation on the sheet P, i.e., the Western-style envelope (S104).

Specifically, the sheet P, or the Western-style envelope, is subjected to the image formation with the pressure roller 110 and the tension roller 150 both placed in the low-pressure contact state with a low pressure contact force. Accordingly, the nip load at the fixing nip N2 is adjusted to be lower than when the tension roller 150 is in the normal pressure-contact state, so that the fixing process can be performed without causing wrinkles and other defects in the Western-style envelope.

When the tension roller 150 is in the low-pressure contact state, the nip length of the fixing nip N2 in the passing direction of the sheet P can be made longer than the nip length provided when the tension roller 150 is in the normal pressure-contact state. This is because, since the outer circumferential surface of the fixing belt 140 at the fixing nip N2 is in a soft state, i.e., a low tension state, by the tension roller 150 in the low-pressure contact state, the pressure roller 110 is allowed to largely bite into the fixing roller 120.

This enables sufficient heating the sheet P, or the Western-style envelope, even when the tension roller 150 is held in the low-pressure contact state. Even on the Western-style envelope as the sheet P, accordingly, the toner image can be appropriately fixed. The fixing device 100 can therefore appropriately perform the fixing process even when the sheet P is the Western-style envelope more likely to get wrinkled than the plain sheet and the Japanese-style envelope.

In the image forming apparatus 1 in the present embodiment, furthermore, as shown in FIG. 2, a condition of the envelope can be input on the operation unit 60 to specify whether or not the envelope is an adhesive envelope having adhesive in advance for bonding an envelope body and a flap as shown in FIG. 2. When the sheet P is the adhesive envelope, the pressure contact force of the tension roller 150 is preferably adjusted to be lower than the pressure contact force for a non-adhesive envelope having no adhesive.

If the adhesive envelope receives a high nip load at the fixing nip N2, this adhesive envelope may cause undesired sticking of the flap to the envelope body with the adhesive. When the pressure contact force of the tension roller 150 is adjusted to be lower, thereby further decreasing the nip load at the fixing nip N2, undesired sticking of the flap with the adhesive during passage through the fixing nip N2 can be prevented.

In the present embodiment, when the sheet P is a plain sheet or a Japanese-style envelope, the fixing process is performed with the tension roller 150 placed in the normal pressure-contact state. Specifically, for the sheet P which is a plain sheet or a Japanese-style envelope, the tension roller 150 is held in the normal pressure-contact state to keep the tensile force applied to the fixing belt 140 as large as possible.

By maintaining the tensile force to be applied to the fixing belt 140 as large as possible, loss of heat generation energy by the heater 131 can be minimized. This reason is as follow. The lower the tensile force to be applied to the fixing belt 140, the lower the contact strength between the fixing belt 140 and the heating roller 130. Further, as the contact strength between the fixing belt 140 and the heating roller 130 is lower, heat is less likely to move from the heater 131 to the fixing belt 140 through the heating roller 130.

Furthermore, since the tensile force applied to the fixing belt 140 is maintained to be as high as possible, the position of the fixing belt 140 can be kept in a proper position. This reason is as follows. The lower the tensile force applied to the fixing belt 140, the fixing belt 140 is more likely to snake in its width direction during rotation. If the tensile force applied to the fixing belt 140 is too low, the snaking fixing belt 140 may deviate from the proper position in an axial direction of the fixing roller 120.

The image forming apparatus in the present embodiment includes the fixing device 100 as described in detail above. When the sheet P is a Western-style envelope which is passed through the fixing nip N2 by side-flap sheet passing, the fixing device 100 is operated to cause the tension adjusting unit 155 to adjust the pressure contact force of the tension roller 150 to lower than the normal pressure contact force for a plain sheet. Since the tension roller 150 is placed in the low-pressure contact state, the outer circumferential surface of the fixing belt 140 at the fixing nip N2 is held in the softer state than when the tension roller 150 is in the normal pressure-contact state for a plain sheet. This makes it possible to suppress generation of wrinkles and others even in the Western-style envelope more likely to get wrinkled during passage through the fixing nip N2. Accordingly, the fixing device and the image forming apparatus capable of appropriately performing the fixing process on the envelope carrying the toner image to fix the toner image on the envelope and also suppressing the generation of wrinkles during the fixing process.

Second Embodiment

A second embodiment will be described below. In this embodiment, the image forming apparatus 1 and the fixing device 100 are identical in structure to those in the first embodiment. This second embodiment differs from the first embodiment in that, when a sheet P is an envelope, the pressure contact force of the tension roller 150 is adjusted according to grammage (basis weight) of the envelope.

When the sheet P is a plain sheet, the pressure adjusting unit 115 in the present embodiment, as in the first embodiment, places the pressure roller 110 in the normal pressure-contact state in which the pressure contact force of the pressure roller 110 is adjusted to a normal pressure contact force allowing a toner image to be appropriately fixed to the plain sheet through the fixing nip N2. When the sheet P is an envelope, the pressure adjusting unit 115 in the present embodiment, as in the first embodiment, places the pressure roller 110 in the low-pressure contact state in which the pressure contact force of the pressure roller 110 is adjusted to be lower than the normal pressure contact force.

Herein, the smaller the grammage, envelopes are more likely to get wrinkled when passing through the fixing nip N2. This is because an envelope having a smaller grammage tends to have lower hardness or strength.

Therefore, when the sheet P is a Western-style envelope, the tension adjusting unit 155 in the present embodiment adjusts the pressure contact force of the tension roller 150 to be lower as the grammage of the Western-style envelope is smaller. When the sheet P is a Western-style envelope and the grammage thereof is less than a predetermined grammage threshold, the tension adjusting unit 155 in the present embodiment adjusts the pressure contact force of the tension roller 150 to be lower than the pressure contact force set when the grammage is equal to or higher than the grammage threshold.

In the present embodiment, therefore, when the sheet P is a Western-style envelope and the grammage thereof is less than the predetermined grammage threshold, the outer circumferential surface of the fixing belt 140 at the fixing nip N2 is adjusted to the softer state than when the grammage is equal to or higher than the grammage threshold. Also in the present embodiment, the hardness of the outer circumferential surface of the fixing belt 140 at the fixing nip N2 represents the hardness of the outer circumferential surface of the fixing belt 140 near the fixing nip N2, which is measured by the C-type Asker rubber hardness meter, as in the first embodiment.

To be concrete, when the grammage of the Western-style envelope is equal to or higher than the grammage threshold, the tension adjusting unit 155 in the present embodiment brings the tension roller 150 into a first low-pressure contact state in which the pressure contact force of the tension roller 150 is set lower than the normal pressure contact force set for a plain sheet. By contrast, when the grammage of the Western-style envelope is less than the grammage threshold, the pressure contact force of the tension roller 150 is adjusted to a further lower force than the pressure contact force set in the first low-pressure contact state, thereby bringing the tension roller 150 into a second low-pressure contact state.

Even a Japanese-style envelope, in the case of a low grammage, is low in hardness and may get wrinkled at the fixing nip N2. That is, for a low grammage, wrinkles and others are easily formed in even the Japanese-style envelope less likely to get wrinkled than the Western-style envelope during sheet passage through the fixing nip N2 provided by the pressure roller 110 held in the low-pressure contact state in which the pressure contact force of the pressure roller 110 is set lower than the normal pressure contact force.

The tension adjusting unit 155 in the present embodiment, accordingly, when the sheet P is a Japanese-style envelope and the grammage thereof is less than a predetermined grammage threshold, the tension roller 150 is brought into the first low-pressure contact state with the pressure contact force set lower than the normal pressure contact force for a plain sheet. In the present embodiment, specifically, for a Japanese-style envelope having a grammage less than a grammage threshold, the pressure contact force of the tension roller 150 is adjusted to equal to the pressure contact force set for a Western-style envelope having a grammage equal to or higher than the grammage threshold.

In contrast, when the sheet P is a Japanese-style envelope and the grammage thereof is equal to or higher than the grammage threshold, the tension adjusting unit 155 brings the tension roller 150 into the normal pressure-contact state with the pressure contact force equal to the normal pressure contact force for a plain sheet. This is because the Japanese-style envelope having a grammage equal to or higher than the grammage threshold can suppress generation of wrinkles and others even when the tension roller 150 is held in the normal pressure-contact state.

Figure 6:
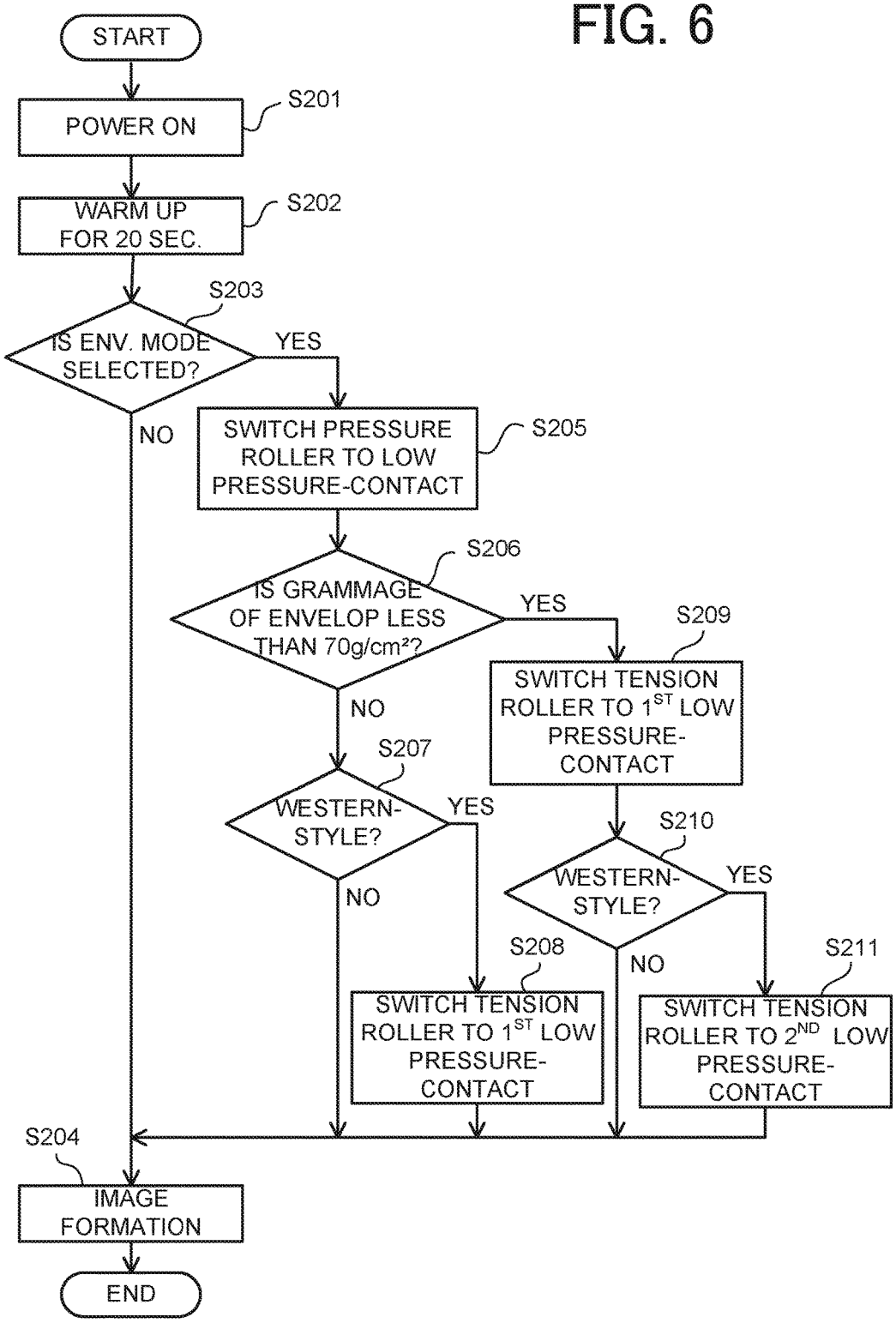
FIG. 6 is a flowchart showing a process of explaining adjustment of pressure contact force of a tension roller in a second embodiment.

FIG. 6 is a flowchart to explain adjustment of the pressure contact force of the tension roller 150 in the present embodiment. In the present embodiment, as shown in FIG. 6, when the image forming apparatus 1 is powered on (S201), the CPU 4 warms up the fixing device 100 (S202).

In the present embodiment, similarly, as the default setting at the time of power-on of the image forming apparatus 1, the pressure roller 110 is set in the normal pressure-contact state with the normal pressure contact force set for a plain sheet in passing through the fixing nip N2. In the default setting of the image forming apparatus 1, the tension roller 150 is also set in the normal pressure-contact state with the normal pressure contact force set for a plain sheet in passing through the fixing nip N2.

In the present embodiment, when the envelope mode is not set, the sheet P stacked in the sheet cassette 51 is determined to be a plain sheet (S203: NO), and thus image formation is executed on the sheet P which is the plain sheet (S204). Specifically, the image formation is performed with the pressure roller 110 and the tension roller 150 both held in the normal pressure-contact state corresponding to the default setting. Accordingly, the fixing device 100 can appropriately perform the fixing process on the sheet P, that is, the plain sheet.

In the present embodiment, similarly, when the envelope mode is selected (S203: NO), the pressure roller 110 is switched to the low-pressure contact state with the low pressure contact force from the normal pressure-contact state corresponding to the default setting (S205). In the present embodiment, successively, it is determined whether or not a set value of the grammage of the envelope in the envelope mode is less than a grammage threshold (S206).

This determination about whether or not the set value of the grammage of the envelope in the envelope mode is less than the grammage threshold can also be made on an input value about the grammage of the envelope input by a user on the operation unit 60. In the present embodiment, the grammage threshold is 70 $g/m^2$.

When the grammage of the envelope in the envelope mode is set to a value equal to or higher than the grammage threshold (S206: NO), it is then determined whether or not a Western-style envelope is set as the envelope in the envelope mode (S207). When a Japanese-style envelope is set as the envelope in the envelope mode (S207: NO), the image forming apparatus 1 executes the image formation on the sheet P determined as the Japanese-style envelope having the grammage equal to or higher than the grammage threshold (S204).

Specifically, this image formation on the Japanese-style envelope having the grammage equal to or higher than the grammage threshold is performed with the pressure roller 110 held in the low-pressure contact state with the low pressure contact force. In this image formation on the Japanese-style envelope having the grammage equal to or higher than the grammage threshold, by contrast, the tension roller 150 is held in the normal pressure-contact state corresponding to the default setting. Accordingly, the fixing device 100 can appropriately implement the fixing process even when the sheet P is the Japanese-style envelope having the grammage equal to or higher than the grammage threshold.

When the grammage of the envelope is set to a value equal to or higher than the grammage threshold (S206: NO) and a Western-style envelope is set as the envelope (S207: YES), the tension roller 150 is switched from the normal pressure-contact state corresponding to the default setting to the first low-pressure contact state with the low pressure contact force (S208). The image forming apparatus 1 executes the image formation on the sheet P determined as the Western-style envelope having the grammage equal to or higher than the grammage threshold (S204).

Specifically, this image formation on the Western-style envelope having the grammage equal to or higher than the grammage threshold is performed with the pressure roller 110 held in the low-pressure contact state and the tension roller 150 held in the first low-pressure contact state. Accordingly, the fixing device 100 can appropriately implement the fixing process even when the sheet P is the Western-style envelope having the grammage equal to or higher than the grammage threshold.

In contrast, when the grammage of the envelope is set to a value less than the grammage threshold (S206: YES), the tension roller 150 is switched from the normal pressure-contact state corresponding to the default setting to the first low-pressure contact state with the low pressure contact force (S209). It is further determined whether or not a Western-style envelope is set as the envelope in the envelope mode (S210). When the Japanese-style envelope is set (S210: NO), the image forming apparatus 1 executes the image formation on the sheet P determined as the Japanese-style envelope having the grammage less than the grammage threshold (S204).

Specifically, this image formation on the Japanese-style envelope having the grammage less than the grammage threshold is performed with the pressure roller 110 held in the low-pressure contact state and the tension roller 150 held in the first low-pressure contact state. Accordingly, the fixing device 100 can appropriately perform the fixing process even when the sheet P is the Japanese-style envelope having the grammage less than the grammage threshold.

When the grammage of the envelope is set to a value less than the grammage threshold (S206: YES) and the Western-style envelope is set as the envelope (S210: YES), the tension roller 150 is switched from the first low-pressure contact state to the second low-pressure contact state in which the pressure contact force is further lower than in the first low-pressure contact state (S211). The image forming apparatus 1 executes the image formation on the sheet P determined as the Western-style envelope having the grammage less than the grammage threshold (S204).

Specifically, this image formation on the Western-style envelope having the grammage less than the grammage threshold is performed with the pressure roller 110 held in the low-pressure contact state and the tension roller 150 held in the second low-pressure contact state. Accordingly, the fixing device 100 can appropriately perform the fixing process even when the sheet P is the Western-style envelope having the grammage less than the grammage threshold.

FIG. 7 is a table showing experimental results in the present embodiment. To be concrete, the table in FIG. 7 shows results of the experiments conducted by passing Western-style envelopes and Japanese-style envelopes, each having a different grammage, through the fixing nip N2 provided by the pressure roller 110 and the tension roller 150 held at different pressure contact forces, and determination is made on whether or not wrinkles and others are generated in each envelope during sheet passage.

In FIG. 7, the column headers "Western-style envelope (Horizontal)" and "Western-style envelope (Horizontal), thin" represent the types of Western-style envelopes to be passed through the fixing nip N2 by side-flap sheet passing. The column headers "Japanese-style envelope (Long, Rectangular, etc.)" and "Japanese-style envelope (Long, Rectangular, etc.), thin" represent the types of Japanese-style envelopes to be passed through the fixing nip N2 by end-flap sheet passing. Furthermore, the "Western-style envelope (Horizontal)" and the "Japanese-style envelope (Long, Rectangular, etc.)" have a grammage equal to or higher than a grammage threshold. The "Western-style envelope (Horizontal), thin" and the "Japanese-style envelope (Long, Rectangular, etc.), thin" have a grammage less than the grammage threshold.

In FIG. 7, a result showing that both wrinkles and flap displacement occur in an envelope passed through the fixing nip N2 is denoted by a mark "X (Defective)". A result showing that either one of wrinkles and flap displacement occurs in an envelope passed through the fixing nip N2 is denoted by a mark "Δ (Partly defective)". Another result showing that both of wrinkles and flap displacement do not occur in an envelope passed through the fixing nip N2 and the envelope has been subjected to an appropriate fixing process is denoted by a mark "○ (Good)".

When both the pressure roller 110 and the tension roller 150 are held in the normal pressure-contact state, every envelope shows a defective result (×) as to listed in FIG. 7. This is because when both the pressure roller 110 and the tension roller 150 are held in the normal pressure-contact state, the nip load is as too high as 450N as indicated in FIG. 7.

When the pressure roller 110 is held in the low-pressure contact state and the tension roller 150 is held in the normal pressure-contact state, the "Japanese-style envelope (long, rectangular, etc.)" shows a good result (○). This is because the pressure roller 110 is held in the low pressure-contact state, thus reducing the nip load. In this case, however, the "Western-style envelope (Horizontal)" and the "Japanese-style envelope (Long, Rectangular, etc.), Thin" show a partly defective result (Δ) and the "Western-style envelope (Horizontal), thin" shows a defective result (×). The reason is that these envelopes are more likely to get wrinkled than the "Japanese-style envelope (Long, Rectangular, etc.)".

When both the pressure roller 110 and the tension roller 150 are held in the low-pressure contact state, every envelope shows a good result (○). This is because the nip load is further reduced by the pressure roller 110 and the tension roller 150 both held in the low pressure-contact state. In the experiment shown in FIG. 7, the low-pressure contact state of the tension roller 150 is set in the first low-pressure contact state for the "Western-style envelope (Horizontal)", "Japanese-style envelope (Long, Rectangular, etc.)", and "Japanese-style envelope (Long, Rectangular, etc.), thin", and set in the second low-pressure contact state for the "Western-style envelope (Horizontal), thin".

The image forming apparatus 1 in the present embodiment specifically adjusts the pressure contact force of the tension roller 150 according to the grammage of an envelope in addition to the orientation of the envelope flap. Thus, it was confirmed that the fixing process could be performed on all the Western-style envelopes and the Japanese-style envelopes having different grammage.

As shown in FIG. 7, the "Japanese-style envelope (Long, Rectangular, etc.)" obtains a good result (○) in any case where the tension roller 150 is held in the normal pressure-contact state or the low-pressure contact state. For the "Japanese-style envelope (Long, Rectangular, etc.)", accordingly, the tension roller 150 can be held in the low-pressure contact state to perform the fixing process. However, it is preferable to place that the tension roller 150 in the normal pressure-contact state as much as possible. This is because the larger tensile force applied on the fixing belt 140 can more reduce the loss of heat-generation energy by the heater 131 and more suppress snaking of the fixing belt 140 during rotation.

In the present embodiment, the grammage threshold is set to 70 g/m$^2$. However, another value may be set as the grammage threshold. In the present embodiment, for both the Western-style envelope and the Japanese-style envelope, the same value is used as the grammage threshold. However, the grammage threshold for the Western-style envelope and the grammage threshold for the Japanese-style envelope may be set to different values.

In the present embodiment, for the Western-style envelope having the grammage equal to or higher than the grammage threshold and the Japanese-style envelope having the grammage less than the grammage threshold, the tension roller 150 is held in the first low-pressure contact state in each case. However, the pressure contact force of the tension roller 150 may be set differently between the case of the Western-style envelope having the grammage equal to or higher than the grammage threshold and the case of the Japanese-style envelope having the grammage less than the grammage threshold.

In the present embodiment, as in the first embodiment, when the sheet P is an adhesive envelope, it is preferable to further reduce the pressure contact force of the tension roller 150 than when the sheet P is a non-adhesive envelope.

In the image forming apparatus 1 in the present embodiment, as described in detail above, the pressure contact force of the tension roller 150 is adjusted according to the grammage of the envelope in addition to the orientation of the envelope flap. Accordingly, the fixing device and the image forming apparatus can appropriately perform the fixing process on the envelope carrying a toner image to fix the toner image thereon and suppress the generation of wrinkles during the fixing process.

Third Embodiment

A third embodiment will be described below. This embodiment differs from the foregoing embodiments in the structure of the fixing device. The structure of the image forming apparatus 1 except the fixing device is identical to that in the foregoing embodiments. Thus, the following explanation is given to only the fixing device in the present embodiment.

Figure 8:
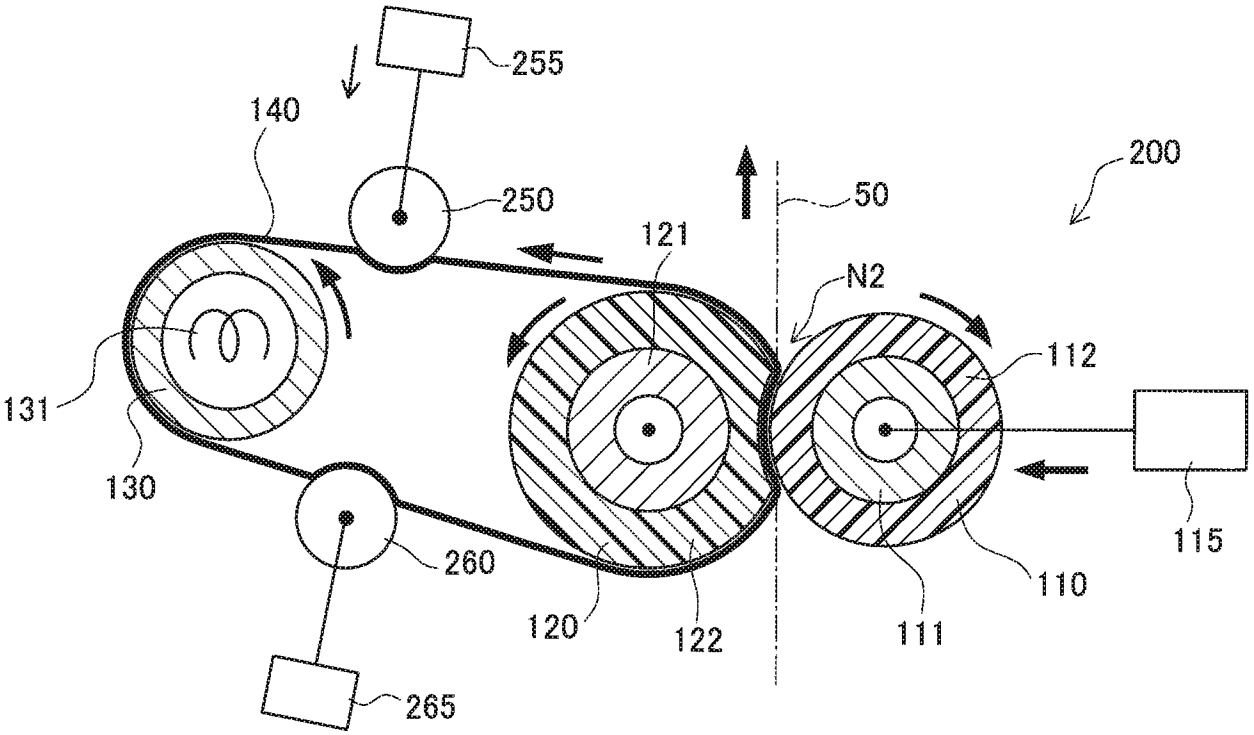
FIG. 8 is a schematic configuration view of a fixing device in a third embodiment.

FIG. 8 is a schematic configuration view of a fixing device 200 in the present embodiment. The image forming apparatus 1 in the present embodiment includes the fixing device 200 shown in FIG. 8 instead of the fixing device 100 shown in FIG. 4. In the fixing device 200 in FIG. 8, identical parts or components to those in the fixing device 100 in FIG. 4 are assigned the same reference signs.

In the fixing device 200 in the present embodiment, the fixing nip N2 is similarly formed at a pressure-contact portion of the pressure roller 110 against the outer circumferential surface of the fixing belt 140. When the sheet P is a plain sheet, in a similar manner to in the foregoing embodiments, the pressure adjusting unit 115 in this embodiment is also held in the normal pressure-contact state in which the pressure contact force of the pressure roller 110 is adjusted to the normal pressure contact force appropriately allowing the toner image to be fixed on the plain sheet through the fixing nip N2. When the sheet P is an envelope, the pressure adjusting unit 115 brings the pressure roller 110 into the low-pressure contact state with the pressure contact force of the pressure roller 110 adjusted to be lower than the normal pressure contact force in a similar manner to the foregoing embodiments.

The fixing device 200 in the third embodiment includes a first tension roller 250 and a second tension roller 260 different from the tension roller 150 in the foregoing embodiments, as shown in FIG. 8. The first tension roller 250 and the second tension roller 260 are each formed of an iron core coated with a fluorine contained resin layer having a thickness of 30 μm. The first tension roller 250 and the second tension roller 260 are each oriented with their axes extending in the width direction of the fixing belt 140, and are pressed against the outer circumferential surface of the fixing belt 140.

To be concrete, the first tension roller 250 is urged in pressure contact with an upper part of the outer circumferential surface of the fixing belt 140 by the first tension adjusting unit 255. This first tension adjusting unit 255 is configured to adjust the pressure contact force of the first tension roller 250. The second tension roller 260 is urged in pressure contact with a lower part of the outer circumferential surface of the fixing belt 140 by the second tension adjusting unit 265. This second tension adjusting unit 265 is configured to adjust the pressure contact force of the second tension roller 260. The first tension adjusting unit 255 and the second tension adjusting unit 265 can be concretely selected from a cam mechanism, a link mechanism, and others.

Figure 9A:
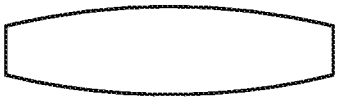
FIGS. 9A and 9B are diagrams showing examples of crown-shaped tension rollers.
Figure 9B:
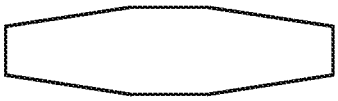

FIGS. 9A and 9B show examples of the shape of the first tension roller 250 oriented with its axis extending in a right and left direction. Specifically, FIGS. 9A and 9B show the available shapes of the first tension roller 250.

The first tension roller 250 shown in FIG. 9A has a radial crown shape. The first tension roller 250 in FIG. 9B has a taper crown shape. Each first tension roller 250 in FIGS. 9A and 9B has a crown shape having a diameter larger in the center in the axial direction than at both ends.

Figure 10A:
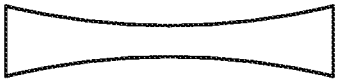
FIGS. 10A and 10B are diagrams showing examples of inverted crown-shaped tension rollers.
Figure 10B:
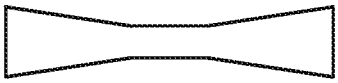

FIGS. 10A and 10B show examples of the shape of the second tension roller 260 oriented with its axis extending in a right and left direction. Specifically, FIGS. 10A and 10B show the available shapes of the second tension roller 260.

The tension roller 260 in FIG. 10A has an inverted radial crown shape. The second tension roller 260 in FIG. 10B has an inverted taper crown shape. Each second tension roller 260 in FIGS. 10A and 10B has an inverted crown shape having a diameter smaller in the center in the axial direction than at both ends.

Regions of the fixing belt 140 individually pressed by the first tension roller 250 and the second tension roller 260 have inner circumferential surfaces not supported by both the fixing roller 120 and the heating roller 130. Accordingly, the first tension roller 250 and the second tension roller 260 held in the pressure contact with the fixing belt 140 can impart the tensile force to the fixing belt 140.

The first tension roller 250, when pressed against the fixing belt 140, can give a larger tensile force to a portion closer to the center of the fixing belt 140 in the width direction. In other words, when pressed against the fixing belt 140, the first tension roller 250 can increase hardness of the outer circumferential surface of the fixing belt 140 at the fixing nip N2 so that the portion closer to the center of the fixing belt 140 in the width direction is harder than the portions close to the both ends.

In contrast, the second tension roller 260, when pressed against the fixing belt 140, can give a larger tensile force to portions closer to both side edges of the fixing belt 140 in the width direction. In other words, when pressed against the fixing belt 140, the second tension roller 260 can increase hardness of the outer circumferential surface of the fixing belt 140 at the fixing nip N2 so that the portions closer to the both side edges of the fixing belt 140 in the width direction are harder than the portion close to the center.

The fixing device 200 in the present embodiment can therefore adjust the pressure contact force of the first tension roller 250 and the pressure contact force of the second tension roller 260 to thereby control the hardness of the outer circumferential surface of the fixing belt 140 at the fixing nip N2. In the present embodiment, specifically, the first tension roller 250 and the first tension adjusting unit 255, and the second tension roller 260 and the second tension adjusting unit 265 constitute a hardness adjusting unit. In the present embodiment, moreover, the pressure contact force of the first tension roller 250 and the pressure contact force of the second tension roller 260 can be individually adjusted to make the hardness of the outer circumferential surface of the fixing belt 140 at the fixing nip N2 different in the width direction.

In the present embodiment, as in the foregoing embodiments, the hardness of the outer circumferential surface of the fixing belt 140 at the fixing nip N2 represents the hardness of the outer circumferential surface of the fixing belt 140 near the fixing nip N2, which is measured by the C-type Asker rubber hardness meter.

The following description is made on the pressure contact force of the first tension roller 250 and the second tension roller 260 used in each of the cases where the sheet P is a plain sheet, a Japanese-style envelope, and a Western-style envelope. In the normal pressure-contact state in which the sheet P is a plain sheet, the first tension roller 250 and the second tension roller 260 are both held in the pressure-contact states. In the normal pressure-contact state, the pressure contact force of the first tension roller 250 and the pressure contact force of the second tension roller 260 are adjusted to render the tensile force applied to the fixing belt 140 uniform in the width direction of the fixing belt 140. Accordingly, the hardness of the outer circumferential surface of the fixing belt 140 at the fixing nip N2 is made uniform in the width direction of the fixing belt 140. This can appropriately perform the fixing process on the plain sheet, because uniform fixing can be performed in the width direction of the fixing belt 140.

To render the hardness of the outer circumferential surface of the fixing belt 140 at the fixing nip N2 uniform in the width direction of the fixing belt 140, the first tension roller 250 shown in FIG. 9A and the second tension roller 260 shown in FIG. 10A are preferably combined. Alternatively, the first tension roller 250 shown in FIG. 9B and the second tension roller 260 shown in FIG. 10B are preferably combined.

It is difficult to render the hardness of the outer circumferential surface of the fixing belt 140 at the fixing nip N2 perfectly uniform in the width direction of the fixing belt 140. In the normal pressure-contact state in the present embodiment, therefore, the hardness of the outer circumferential surface of the fixing belt 140 near the fixing nip N2 is measured by the C-type Asker rubber hardness meter at more than one point on the outer circumferential surface of the fixing belt 140 in the width direction, and the hardness of the fixing belt 140 is adjusted so that a hardness difference between a maximum and a minimum of the measured values is within 4 degrees.

In the case of using the Japanese-style envelope as the sheet P, as with the case of using the plain sheet, the normal pressure-contact state is established. Specifically, both the first tension roller 250 and the second tension roller 260 are held in the pressure-contact state so that, in this case of using the Japanese-style envelope as the sheet P, the tensile force applied on the fixing belt 140 is rendered uniform in the width direction of the fixing belt 140. In this way, when the sheet P is the Japanese-style envelope, the hardness of the outer circumferential surface of the fixing belt 140 at the fixing nip N2 is rendered uniform in the width direction of the fixing belt 140. This can also appropriately perform the fixing process on the sheet P determined as the Japanese-style envelope.

When the sheet P is a Japanese-style envelope having a grammage less than the grammage threshold, as described in the second embodiment, the Japanese-style envelope is likely to get wrinkled. In this case, therefore, the outer circumferential surface of the fixing belt 140 at the fixing nip N2 is preferably brought into the softer state than that when the sheet P is a plain sheet. In this case, the pressure contact force of the first tension roller 250 and the pressure contact force of the second tension roller 260 each have only to be set lower than those in the normal pressure-contact state for a plain sheet. This is because the hardness of the outer circumferential surface of the fixing belt 140 at the fixing nip N2 can be made lower than that in the normal pressure-contact state while the hardness of the outer circumferential surface of the fixing belt 140 at the fixing nip N2 is kept uniform in the width direction.

When the sheet P is a Western-style envelope, the first tension roller 250 is placed in the pressure-contact state, whereas the second tension roller 260 is held in a non-pressure contact state. Since the second tension roller 260 is in the non-pressure contact state, the tensile force applied to the fixing belt 140 can be reduced. Further, the tensile force applied to the fixing belt 140 can be adjusted to be lower as portions closer to the side edges of the fixing belt 140 in the width direction. Specifically, the hardness of the outer circumferential surface of the fixing belt 140 at the fixing nip N2 in the width direction of the fixing belt 140 can be made lower than that in the normal pressure-contact state, and also made lower in portions closer to the side edges in the width direction of the fixing belt 140. Thus, the Western-style envelope is conveyed to the fixing nip N2 provided by the fixing belt 140 made softer toward the side edges in the width direction so that the center of the Western-style envelope in a width direction perpendicular to the sheet passing direction passes through the center of the fixing belt 140 in the width direction.

This can reduce the nip load in the flap portion located in the side edge part of the Western-style envelope in the width direction. Specifically, reducing the nip load on the portions near the flap in which wrinkles and others are likely to occur during sheet passing can suppress the generation of the wrinkles and others of the Western-style envelope.

For Western-style envelopes, a part in and around the center in the width direction is often applied with image formation. The part in and around the center in the width direction of the Western-style envelope on which the image is formed can maintain the fixing property without reducing the nip load not so largely. Accordingly, the fixing device 200 in the present embodiment can appropriately perform the fixing process even for the sheet P which is the Western-style envelope.

When the sheet P is the Western-style envelope having the grammage less than the grammage threshold, as described above in the second embodiment, this Western-style envelope is likely to get wrinkled. Thus, it is preferable to adjust the outer circumferential surface of the fixing belt 140 at the fixing nip N2 to the softer state than when the sheet P is a Western-style envelope having the grammage equal to or higher than the grammage threshold. Accordingly, for the sheet P determined as the Western-style envelope having the grammage less than the grammage threshold, the pressure contact force of the first tension roller 250 has only to be set lower than that for the sheet P determined as the Western-style envelope having a grammage equal to or higher than the grammage threshold.

Also the Western-style envelope, the second tension roller 260 may be brought in the pressure-contact state. Specifically, since the pressure contact force of the second tension roller 260 is set lower than that in the normal pressure-contact state, the hardness of the outer circumferential surface of the fixing belt 140 at the fixing nip N2 can be made lower toward the side edges in the width direction of the fixing belt 140.

When the Western-style envelope has a long side in the width direction parallel to the width direction of the fixing belt 140, it is preferable to render the hardness of the outer circumferential surface of the fixing belt 140 at the fixing nip N3 uniform in the width direction. In the Western-style envelope long in the width direction, an image(s) may be formed in a portion that will pass through a side edge portion of the fixing belt 140.

For a Western-style envelope having a length in the width direction longer than a predetermined threshold length, the pressure contact force of the first tension roller 250 and the pressure contact force of the second tension roller 260 have only to be adjusted to render the hardness of the outer circumferential surface of the fixing belt 140 at the fixing nip N2 uniform in the width direction. At that time, both the pressure contact force of the first tension roller 250 and the pressure contact force of the second tension roller 260 have only to be set lower than those in the normal pressure-contact state. In contrast, for a Western-style envelope having a length in the width direction less than the predetermined threshold length, the pressure contact force of the first tension roller 250 and the pressure contact force of the second tension roller 260 have only to be adjusted so that the hardness of the outer circumferential surface of the fixing belt 140 at the fixing nip N2 is lower toward the side edge portions in the width direction.

The fixing device 200 in the present embodiment, as described in detail above, includes the first tension roller 250 and the second tension roller 260. The first tension roller 250 has a crown shape having a diameter larger in the center corresponding to a center position in the width direction of the Western-style envelope that will be passed through the fixing nip N2 by side-flap sheet passing than both ends in the axial direction. While the Western-style envelope passes through the fixing nip N2, the outer circumferential surface of the fixing belt 140 at the fixing nip N2 can be made softer toward the side edge portions of the fixing belt 140 in the width direction. Accordingly, the fixing device and the image forming apparatus can be achieved in which the fixing process on the envelope carrying a toner image is performed to fix the toner image on the envelope and the wrinkles during the fixing process can be suppressed.

The foregoing embodiments are mere examples and give no limitations to the present invention. The present invention may be embodied in other specific forms without departing from the essential characteristics thereof. For instance, the pressure-contact region of the tension roller on the fixing belt 140 may be a position different from the position in the foregoing embodiment. To be concrete, the region may be any region other than the region of the fixing belt 140 whose inner circumferential surface is supported. The tension roller may be pressure-contacted with the inner circumferential surface of the fixing belt 140 instead of the outer circumferential surface shown in the foregoing embodiment.

For example, the heating roller 130 may be also used as a tension roller. In this case, the heating roller 130 is urged in a direction to move away from the fixing roller 120, thereby adjusting the tensile force of the fixing belt 140. In some cases, however, a temperature sensor, a thermostat, and others may be provided near the heating roller 130. In such a case, a tension roller is preferably provided as a separate component from the heating roller 130 as in the foregoing embodiments. Because when the heating roller 130 is also used as the tension roller, fine adjustment of the tensile force of the fixing belt 140 may cause an undesired change in the distance between the heating roller 130 and the temperature sensor and others. Specifically, when the tension roller is provided separately from the heating roller 130, thereby enabling keeping a constant distance between the heating roller 130 and the temperature sensor and others, the temperature sensor and others can function appropriately.

The pressure contact force of the pressure roller 110 in the normal pressure-contact state and the low-pressure contact state can be previously determined by experiments or the like performed in advance. The pressure contact force, grammage threshold, threshold length, and other conditions of the tension rollers 150, 250, and 260 can be similarly determined in advance by experiments or the like performed in advance. Each value determined in advance has only to be stored in a nonvolatile memory attached to a main unit.

The present invention is not limited to a color printer and may be applied to such an image forming apparatus as to make transmission and reception of print jobs via a public line. For instance, the invention is applicable, not only to the configuration of the fixing device described in the foregoing embodiments, but also to any configuration having a fixing belt. For example, not limited to the heater 131, a fixing device of an electromagnetic induction heating type may be adopted.

Specifically, the fixing device in the foregoing embodiments comprises: an endless fixing belt; a heating source to heat the fixing belt; a support member including a support elastic layer formed of elastic material, and a support base having higher rigidity than the support elastic layer, the support member being configured such that the support base supports an inner circumferential surface of the fixing belt through the support elastic layer; and a nip pressing member provided in pressure contact with an outer circumferential surface of the fixing belt in a supported region in which the inner circumferential surface is supported by the support member, the nip pressing member being configured to form a nip at a pressure-contact portion against the outer circumferential surface of the fixing belt, the fixing device being configured to pass a sheet carrying a toner image through the nip to fix the toner image to the sheet, wherein the fixing device further includes a hardness adjusting unit to adjust hardness of the outer circumferential surface of the fixing belt at the nip, and the hardness adjusting unit is configured such that, when the sheet to be passed through the nip is an envelope having a flap, the envelope being conveyed in a sheet passing direction by side-flap sheet passing for feeding the envelope, through the nip, in an orientation that a fold line between an envelope body and a flap extends in the sheet passing direction, the hardness adjusting unit brings the outer circumferential surface of the fixing belt at the nip during passage of the sheet through the nip into a softer state than when the sheet to be passed through the nip is a plain sheet.

This fixing device performs the fixing process on an envelope to be passed through the nip by the side-flap sheet passing while the outer circumferential surface of the fixing belt at the nip is in the softer state than the outer circumferential surface of the fixing belt at the nip for a plain sheet. Accordingly, while the envelope is passing through the nip by the side-flap sheet passing, the nip load can be kept low. In other words, the nip load can be reduced to such a degree as to enable suppressing the generation of wrinkles and others in the envelope to be passed through the nip by the side-flap sheet passing without excessively reducing the pressure contact force of the nip pressing member. This can enable performing the fixing process on the envelope carrying a toner image to fix the toner image on the envelope and preventing the generation of wrinkles during the fixing process.

In the foregoing fixing device, preferably, the hardness adjusting unit is configured such that when the envelope to be passed through the nip by the side-flap sheet passing has a grammage less than a predetermined first grammage threshold, the hardness adjusting unit brings the outer circumferential surface of the fixing belt at the nip during passage of the sheet through the nip into a softer state than when an envelope has a grammage equal to or higher than the first grammage threshold. In the side-flap sheet passing, the lower the grammage of an envelope, wrinkles and others are more likely to be generated. The above-described configuration can more decrease the nip load when the grammage of the envelope is low than when the grammage is high, so that the generation of wrinkles and others is prevented.

In the foregoing fixing device, preferably, the hardness adjusting unit is configured such that, when the sheet to be passed through the nip is an envelope having a flap, the envelope being conveyed in a sheet passing direction by end-flap sheet passing for feeding the envelope, through the nip, in an orientation that a fold line between an envelope body and a flap extends in a width direction of the fixing belt, and the envelope to be passed through the nip by the end-flap sheet passing having a grammage less than a predetermined second grammage threshold, the hardness adjusting unit brings the outer circumferential surface of the fixing belt at the nip during passage of the sheet through the nip into a softer state than when the sheet to be passed through the nip is a plain sheet. Even in the end-flap sheet passing for an envelope less likely to cause wrinkles and others, the wrinkles and others may be generated if the grammage of the envelope is low. The above-described configuration can reduce the nip load for the envelope with low grammage to be subjected to the end-flap sheet passing to suppress the generation of wrinkles and others.

In the foregoing fixing device, preferably, the hardness adjusting unit is configured such that, when the sheet to be passed through the nip is an adhesive envelope having adhesive with which a flap is bonded to an envelope body, the hardness adjusting unit brings the outer circumferential surface of the fixing belt at the nip during passage of the sheet through the nip into a softer state than when the sheet is a non-adhesive envelope having no adhesive. For an adhesive envelope, it may cause sticking of a flap to a body of the envelope due to the adhesive when this envelope passes through the nip with a high nip load. To avoid such a defect, the nip load can be reduced to prevent unintended sticking of the flap to the body of the adhesive envelope.

In the foregoing fixing device, preferably, the hardness adjusting unit includes: a first tension roller oriented with its axis extending in a width direction of the fixing belt, the first tension roller being placed in pressure contact with a first pressure-contact region of the fixing belt in which the inner circumferential surface is not supported; and a first urging adjusting unit configured to urge the first tension roller against the first pressure-contact region of the fixing belt and to adjust an urging force of the first tension roller, and the first urging adjusting unit is configured to set the urging force of the first tension roller to be lower to adjust the outer circumferential surface of the fixing belt at the nip to a softer state.

In the foregoing fixing device, preferably, the first tension roller has a crown shape radially expanding in a central portion more than in both end portions in an axial direction, and the first tension roller has a most radially expanded portion located in a position corresponding to a center position of the envelope, in the width direction of the fixing belt, to be passed through the nip by the side-flap sheet passing. A central part of the envelope to be passed by the side-flap sheet passing frequently bears a toner image to be fixed by the fixing process. In an envelope to be passed by the side-flap sheet passing, a flap likely to get wrinkled is provided in the side edge portion of the envelope. It is thus possible to ensure the fixing property in the center part of the envelope to be passed by the side-flap sheet passing and also prevent the flap in the side edge portion from getting wrinkled.

In the foregoing fixing device, preferably, the hardness adjusting unit includes: a second tension roller oriented with its axis extending in the width direction of the fixing belt, the second tension roller being placed in pressure contact with a second pressure-contact region of the fixing belt in which the inner circumferential surface is not supported; and a second urging adjusting unit configured to urge the second tension roller against the second pressure-contact region of the fixing belt and to adjust an urging force of the second tension roller, and the second tension roller has an inverted crown shape radially recessed in both ends more than in a central portion in an axial direction, the second tension roller has a most radially recessed portion located in a position corresponding to the most radially expanding portion of the first tension roller, in the width direction of the fixing belt, and the second urging adjusting unit is configured to set an urging force of the second tension roller to be smaller to adjust the outer circumferential surface of the fixing belt at the nip to a softer state. Specifically, when a plain sheet or the like is to be passed through the nip, the outer circumferential surface of the fixing belt at the nip is rendered hard. A plain sheet bears a toner image in an end portion in the width direction with high frequency. When the outer circumferential surface of the fixing belt at the nip is to be made hard, the side edge portions of the outer circumferential surface of the fixing belt in the width direction at the nip is also rendered hard, so that the fixing property near the side edge portions can be ensured.

In the foregoing fixing device, preferably, when the sheet to be passed through the nip has a length in the width direction of the fixing belt is longer than a predetermined threshold length, the first urging adjusting unit and the second urging adjusting unit respectively adjust the urging force of the first tension roller and the urging force of the second tension roller so that a tensile force applied to the fixing belt is uniform in the width direction. Specifically, even for an envelope to be passed through the nip by the side-flap sheet passing, if it has a long length in the width direction, the fixing property needs to be high even in the side edge portions in the width direction of the belt because a toner image is borne on the side edge portions.

The foregoing fixing device preferably further includes a nip pressure adjusting unit to adjust pressure contact force of the nip pressing member to an outer circumferential surface of the fixing belt, wherein when the sheet to be passed through the nip is an envelope, the nip pressure adjusting unit sets the urging force of the nip pressing member during passage of the sheet through the nip to be lower than when the sheet is a plain sheet. This can reduce the nip load and thus prevent the generation of wrinkles and others in the envelope.

In the foregoing fixing device, preferably, the support member is a roller member provided with the support elastic layer on a surface of the support base, the nip pressing member is a roller member provided with a pressing elastic layer having elasticity and a pressing base having higher rigidity than the pressing elastic layer, the pressing elastic layer being provided on a surface of the pressing base material, and the support elastic layer has a thickness larger than the pressing elastic layer.

The foregoing fixing device preferably further includes a heating roller formed of a roller member to be heated by the heating source and configured to support the inner circumferential surface of the fixing belt other than the supported region, and wherein the heating source is configured to heat the fixing belt through the heating roller.

The image forming apparatus described in the foregoing embodiments is the image forming apparatus comprises: a conveying unit for conveying a sheet; an image forming unit configured to transfer a toner image to the sheet; and the fixing device according to claim 1, provided more downstream than the image forming unit in a sheet conveying direction. Accordingly, this can appropriately perform the fixing process on the envelope carrying a toner image to fix the toner image on the envelope and also prevent the generation of wrinkles in the envelope during the fixing process.

EXPLANATIONS OF REFERENCE SIGNS

1 Image forming apparatus
100, 200 Fixing device
110 Pressure roller
115 Pressure adjusting unit
120 Fixing roller
130 Heating roller
140 Fixing belt
131 Heater
150 Tension roller
155 Tension adjusting unit
250 First tension roller
255 First tension adjusting unit
260 Second tension roller
265 Second tension adjusting unit
N2 Fixing nip
P Sheet

What is claimed is:

1. A fixing device comprising:

an endless fixing belt;

a heating source to heat the fixing belt;

a support member including a support elastic layer formed of elastic material, and a support base having higher rigidity than the support elastic layer, the support member being configured such that the support base supports an inner circumferential surface of the fixing belt through the support elastic layer; and a nip pressing member provided in pressure contact with an outer circumferential surface of the fixing belt in a supported region in which the inner circumferential surface is supported by the support member, the nip pressing member being configured to form a nip at a pressure-contact portion against the outer circumferential surface of the fixing belt, the fixing device being configured to pass a sheet carrying a toner image through the nip to fix the toner image to the sheet, wherein the fixing device further includes a hardness adjusting unit to adjust hardness of the outer circumferential surface of the fixing belt at the nip, and the hardness adjusting unit is configured such that, when the sheet to be passed through the nip is an envelope having a flap, the envelope being conveyed in a sheet passing direction by side-flap sheet passing for feeding the envelope, through the nip, in an orientation that a fold line between an envelope body and a flap extends in the sheet passing direction, the hardness adjusting unit brings the outer circumferential surface of the fixing belt at the nip during passage of the sheet through the nip into a softer state than when the sheet to be passed through the nip is a plain sheet, and wherein the hardness adjusting unit includes:

a first tension roller oriented with its axis extending in a width direction of the fixing belt, the first tension roller being placed in pressure contact with a first pressure-contact region of the fixing belt in which the inner circumferential surface is not supported, the first tension roller having a crown shape radially expanding in a central portion more than in both end portions in an axial direction, the first tension roller having a most radially expanded portion located in a position corresponding to a center position of the envelope, in the width direction of the fixing belt, to be passed through the nip by the side-flap sheet passing;

a first urging adjusting unit configured to urge the first tension roller against the first pressure-contact region of the fixing belt and to adjust an urging force of the first tension roller;

the first urging adjusting unit is configured to set the urging force of the first tension roller to be lower to adjust the outer circumferential surface of the fixing belt at the nip to a softer state;

a second tension roller oriented with its axis extending in the width direction of the fixing belt, the second tension roller being placed in pressure contact with a second pressure-contact region of the fixing belt in which the inner circumferential surface is not supported, the second tension roller having an inverted crown shape radially recessed in a central portion more than in both ends in an axial direction, the second tension roller having a most radially recessed portion located in a position corresponding to the most radially expanding portion of the first tension roller, in the width direction of the fixing belt; and a second urging adjusting unit configured to urge the second tension roller against the second pressure-contact region of the fixing belt and to adjust an urging force of the second tension roller; and the second urging adjusting unit is configured to set an urging force of the second tension roller to be smaller to adjust the outer circumferential surface of the fixing belt at the nip to the softer state.

2. The fixing device according to claim 1, wherein the hardness adjusting unit is configured such that when the envelope to be passed through the nip by the side-flap sheet passing has a grammage less than a predetermined first grammage threshold, the hardness adjusting unit brings the outer circumferential surface of the fixing belt at the nip during passage of the sheet through the nip into a softer state than when an envelope has a grammage equal to or higher than the first grammage threshold.

3. The fixing device according to claim 1, wherein the hardness adjusting unit is configured such that, when the sheet to be passed through the nip is an envelope having a flap, the envelope being conveyed in a sheet passing direction by end-flap sheet passing for feeding the envelope, through the nip, in an orientation that a fold line between an envelope body and a flap extends in a width direction of the fixing belt, and the envelope to be passed through the nip by the end-flap sheet passing having a grammage less than a predetermined second grammage threshold, the hardness adjusting unit brings the outer circumferential surface of the fixing belt at the nip during passage of the sheet through the nip into a softer state than when the sheet to be passed through the nip is a plain sheet.

4. The fixing device according to claim 1, wherein the hardness adjusting unit is configured such that, when the sheet to be passed through the nip is an adhesive envelope having adhesive with which a flap is bonded to an envelope body, the hardness adjusting unit brings the outer circumferential surface of the fixing belt at the nip during passage of the sheet through the nip into a softer state than when the sheet is a non-adhesive envelope having no adhesive.

5. The fixing device according to claim 1, wherein when the sheet to be passed through the nip has a length in the width direction of the fixing belt is longer than a predetermined threshold length, the first urging adjusting unit and the second urging adjusting unit respectively adjust the urging force of the first tension roller and the urging force of the second tension roller so that a tensile force applied to the fixing belt is uniform in the width direction.

6. The fixing device according to claim 1, further including a nip pressure adjusting unit to adjust pressure contact force of the nip pressing member to an outer circumferential surface of the fixing belt, wherein when the sheet to be passed through the nip is an envelope, the nip pressure adjusting unit sets the urging force of the nip pressing member during passage of the sheet through the nip to be lower than when the sheet is a plain sheet.

7. The fixing device according to claim 1, wherein the support member is a roller member provided with the support elastic layer on a surface of the support base, the nip pressing member is a roller member provided with a pressing elastic layer having elasticity and a pressing base having higher rigidity than the pressing elastic layer, the pressing elastic layer being provided on a surface of the pressing base material, and the support elastic layer has a thickness larger than the pressing elastic layer.

8. The fixing device according to claim 1, further including a heating roller formed of a roller member to be heated by the heating source and configured to support the inner circumferential surface of the fixing belt other than the supported region, and wherein the heating source is configured to heat the fixing belt through the heating roller.

9. An image forming apparatus comprising:

a conveying unit for conveying a sheet;

an image forming unit configured to transfer a toner image to the sheet; and the fixing device according to claim 1, provided more downstream than the image forming unit in a sheet conveying direction.

10. A fixing device comprising:

an endless fixing belt;

a heating source to heat the fixing belt;

a support member including a support elastic layer formed of elastic material, and a support base having higher rigidity than the support elastic layer, the support member being configured such that the support base supports an inner circumferential surface of the fixing belt through the support elastic layer; and a nip pressing member provided in pressure contact with an outer circumferential surface of the fixing belt in a supported region in which the inner circumferential surface is supported by the support member, the nip pressing member being configured to form a nip at a pressure-contact portion against the outer circumferential surface of the fixing belt, the fixing device being configured to pass a sheet carrying a toner image through the nip to fix the toner image to the sheet, wherein the fixing device further includes a hardness adjusting unit to adjust hardness of the outer circumferential surface of the fixing belt at the nip, the hardness adjusting unit comprising a tension roller on the outer circumferential surface of the fixing belt, the tension roller having an axis that is movable relative to an axis of the support member; and the hardness adjusting unit is configured such that, when the sheet to be passed through the nip is an envelope having a flap, the envelope being conveyed in a sheet passing direction by side-flap sheet passing for feeding the envelope, through the nip, in an orientation that a fold line between an envelope body and a flap extends in the sheet passing direction, the hardness adjusting unit brings the outer circumferential surface of the fixing belt at the nip during passage of the sheet through the nip into a softer state than when the sheet to be passed through the nip is a plain sheet, and wherein the hardness adjusting unit includes:

the tension roller as a first tension roller oriented with its axis extending in a width direction of the fixing belt, the first tension roller being placed in pressure contact with a first pressure-contact region of the fixing belt in which the inner circumferential surface is not supported, the first tension roller having a crown shape radially expanding in a central portion more than in both end portions in an axial direction, the first tension roller having a most radially expanded portion located in a position corresponding to a center position of the envelope, in the width direction of the fixing belt, to be passed through the nip by the side-flap sheet passing;

a first urging adjusting unit configured to urge the first tension roller against the first pressure-contact region of the fixing belt and to adjust an urging force of the first tension roller;

the first urging adjusting unit is configured to set the urging force of the first tension roller to be lower to adjust the outer circumferential surface of the fixing belt at the nip to a softer state;

a second tension roller oriented with its axis extending in the width direction of the fixing belt, the second tension roller being placed in pressure contact with a second pressure-contact region of the fixing belt in which the inner circumferential surface is not supported, the second tension roller having an inverted crown shape radially recessed in a central portion more than in both ends in an axial direction, the second tension roller having a most radially recessed portion located in a position corresponding to the most radially expanding portion of the first tension roller, in the width direction of the fixing belt;

a second urging adjusting unit configured to urge the second tension roller against the second pressure-contact region of the fixing belt and to adjust an urging force of the second tension roller; and the second urging adjusting unit is configured to set an urging force of the second tension roller to be smaller to adjust the outer circumferential surface of the fixing belt at the nip to the softer state.

11. The fixing device according to claim 10, wherein the hardness adjusting unit is configured such that when the envelope to be passed through the nip by the side-flap sheet passing has a grammage less than a predetermined first grammage threshold, the hardness adjusting unit brings the outer circumferential surface of the fixing belt at the nip during passage of the sheet through the nip into a softer state than when an envelope has a grammage equal to or higher than the first grammage threshold.

12. The fixing device according to claim 10, wherein the hardness adjusting unit is configured such that, when the sheet to be passed through the nip is an envelope having a flap, the envelope being conveyed in a sheet passing direction by end-flap sheet passing for feeding the envelope, through the nip, in an orientation that a fold line between an envelope body and a flap extends in a width direction of the fixing belt, and the envelope to be passed through the nip by the end-flap sheet passing having a grammage less than a predetermined second grammage threshold, the hardness adjusting unit brings the outer circumferential surface of the fixing belt at the nip during passage of the sheet through the nip into a softer state than when the sheet to be passed through the nip is a plain sheet.

13. The fixing device according to claim 10, wherein the hardness adjusting unit is configured such that, when the sheet to be passed through the nip is an adhesive envelope having adhesive with which a flap is bonded to an envelope body, the hardness adjusting unit brings the outer circumferential surface of the fixing belt at the nip during passage of the sheet through the nip into a softer state than when the sheet is a non-adhesive envelope having no adhesive.

14. The fixing device according to claim 10, wherein when the sheet to be passed through the nip has a length in the width direction of the fixing belt is longer than a predetermined threshold length, the first urging adjusting unit and the second urging adjusting unit respectively adjust the urging force of the first tension roller and the urging force of the second tension roller so that a tensile force applied to the fixing belt is uniform in the width direction.

15. The fixing device according to claim 10, further including a nip pressure adjusting unit to adjust pressure contact force of the nip pressing member to an outer circumferential surface of the fixing belt, wherein when the sheet to be passed through the nip is an envelope, the nip pressure adjusting unit sets the urging force of the nip pressing member during passage of the sheet through the nip to be lower than when the sheet is a plain sheet.

16. The fixing device according to claim 10, wherein the support member is a roller member provided with the support elastic layer on a surface of the support base, the nip pressing member is a roller member provided with a pressing elastic layer having elasticity and a pressing base having higher rigidity than the pressing elastic layer, the pressing elastic layer being provided on a surface of the pressing base material, and the support elastic layer has a thickness larger than the pressing elastic layer.

17. The fixing device according to claim 10, further including a heating roller formed of a roller member to be heated by the heating source and configured to support the inner circumferential surface of the fixing belt other than the supported region, and wherein the heating source is configured to heat the fixing belt through the heating roller.

18. An image forming apparatus comprising:

a conveying unit for conveying a sheet;

an image forming unit configured to transfer a toner image to the sheet; and the fixing device according to claim 10, provided more downstream than the image forming unit in a sheet conveying direction.

* * * * *